US007744180B2

(12) United States Patent
Mohri et al.

(10) Patent No.: US 7,744,180 B2
(45) Date of Patent: Jun. 29, 2010

(54) RECORDING DEVICE

(75) Inventors: Satoshi Mohri, Kanagawa (JP); Hiroshi Ikeda, Kanagawa (JP); Masatoshi Araki, Kanagawa (JP); Manabu Numata, Kanagawa (JP); Kunichi Yamashita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 361 days.

(21) Appl. No.: 11/818,118

(22) Filed: Jun. 13, 2007

(65) Prior Publication Data

US 2008/0151034 A1 Jun. 26, 2008

(30) Foreign Application Priority Data

Dec. 26, 2006 (JP) ..... 2006-349814

(51) Int. Cl.
*B41J 2/005* (2006.01)
*B41J 2/01* (2006.01)
*B41J 3/00* (2006.01)

(52) U.S. Cl. ..... 347/1

(58) Field of Classification Search ..... 347/1, 347/213

See application file for complete search history.

(56) References Cited

FOREIGN PATENT DOCUMENTS

| | | |
|---|---|---|
| JP | 2000-94654 | 4/2000 |
| JP | 2000-343808 | 12/2000 |
| JP | 2001-191505 | 7/2001 |
| JP | 2002-321443 | 11/2002 |
| JP | 2002-370347 | 12/2002 |
| JP | 2003-57967 | 2/2003 |
| JP | 2006-137120 | 6/2006 |
| JP | 2006-347085 | * 12/2006 |
| JP | 2007-190745 | * 8/2007 |

OTHER PUBLICATIONS

Computer-generated translation of JP 2006-347085, published Dec. 26, 2006.*

* cited by examiner

*Primary Examiner*—Huan H Tran
(74) *Attorney, Agent, or Firm*—Fildes & Outland, P.C.

(57) ABSTRACT

A recording device including an intermediate transfer unit; a supply unit that supplies ink receiving particles that receive an ink onto the intermediate transfer unit in the form of a layer; a particle density increasing unit that increases the particle density of the layer of the ink receiving particles supplied onto the intermediate transfer unit; an ink application unit that applies an ink to the layer of the ink receiving particles supplied onto the intermediate transfer unit; a transfer unit that transfers the layer of the ink receiving particles onto a recording medium; and a fixing unit that fixes the layer of the ink receiving particles transferred onto the recording medium.

20 Claims, 11 Drawing Sheets

RECORDING DEVICE

CROSS-REFERENCE TO RELATED APPLICATION

This application is based on and claims priority under 35 USC 119 from Japanese Patent Application No. 2006-349814 filed on Dec. 26, 2006.

BACKGROUND

1. Technical Field

The present invention relates to a recording device.

2. Related Art

The ink jet recording method is known as one of the methods of recording image and data using ink. The mechanism of the ink jet recording method is such that the ink in the form of a liquid or a melted solid is ejected from a nozzle, slit, porous film or the like onto paper, cloth, film or the like to record. As a method of ejecting ink, there have been proposed various methods such as a charge control method in which ink is ejected by electrostatic attraction force; a pressure pulse method in which ink is ejected by oscillation pressure of piezo elements; and a thermal ink jet method in which ink is ejected by pressure generated by forming and growing of air bubbles under high temperature. Images or data of extremely high definition can be recorded by these methods.

Among the recording methods using ink, including these ink jet recording methods, there have been proposed a method in which an image is first recorded on an intermediate body, and the image is then transferred onto a recording medium, in order to record an image with high image quality on various types of recording media such as permeable media and impermeable media.

SUMMARY

According to an aspect of the invention, there is provided a recording device A recording device comprising:

an intermediate transfer unit;

a supply unit that supplies ink receiving particles that receive an ink onto the intermediate transfer unit in the form of a layer;

a particle density increasing unit that increases the particle density of the layer of the ink receiving particles supplied onto the intermediate transfer unit;

an ink application unit that applies an ink to the layer of the ink receiving particles supplied onto the intermediate transfer unit;

a transfer unit that transfers the layer of the ink receiving particles onto a recording medium; and a fixing unit that fixes the layer of the ink receiving particles transferred onto the recording medium.

BRIEF DESCRIPTION OF THE DRAWINGS

Exemplary embodiments of the present invention will be described in detail based on the following figures, wherein.

DETAILED DESCRIPTION

Some embodiments of the invention are described below with reference to the drawings. Elements having substantially the same effects or functions are represented by the same reference marks in all of the drawings, and overlapping description thereof is omitted in some cases.

First Embodiment

Figure 1:
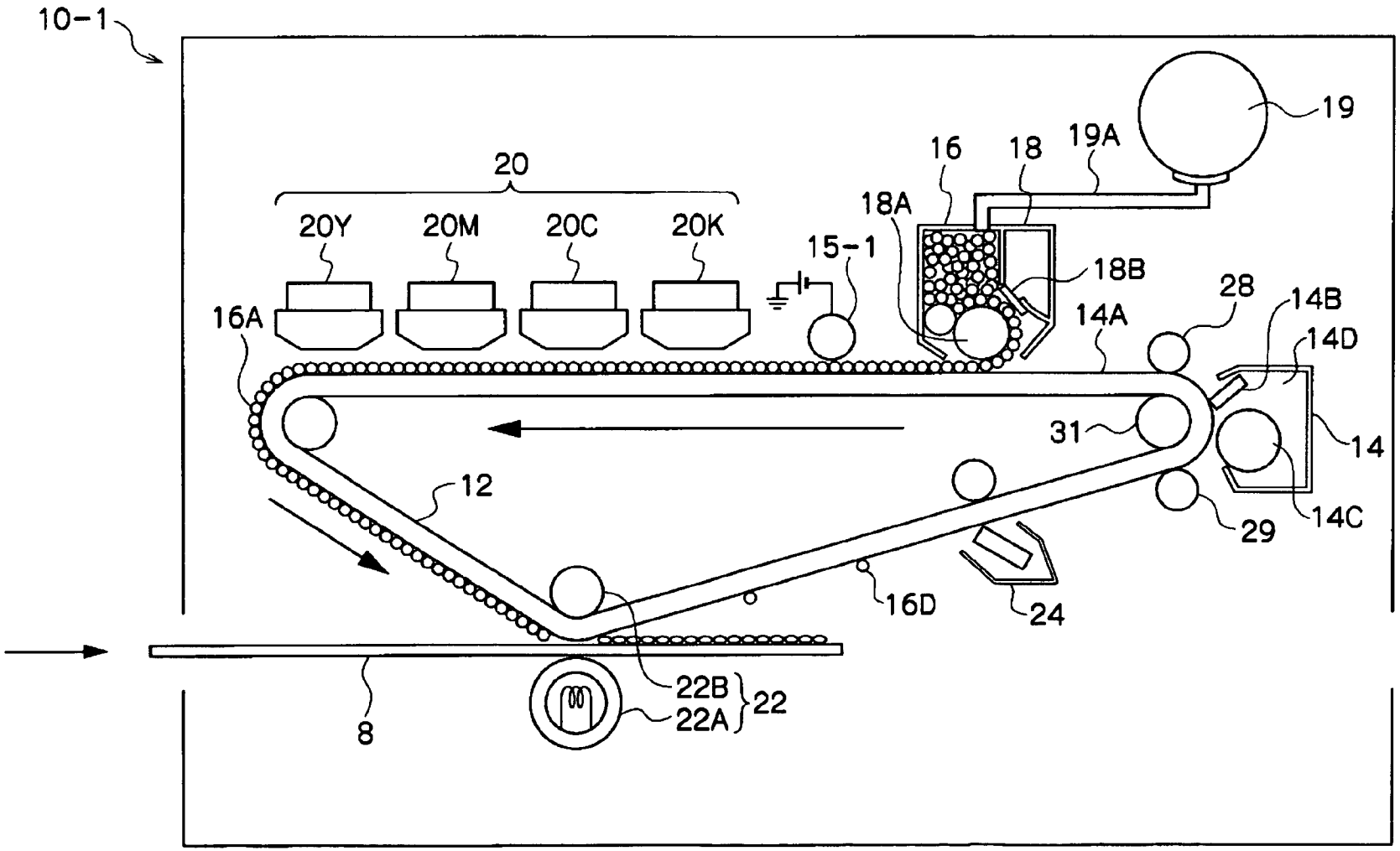
FIG. 1 is a schematic diagram showing a recording device according to a first exemplary embodiment.
Figure 2:
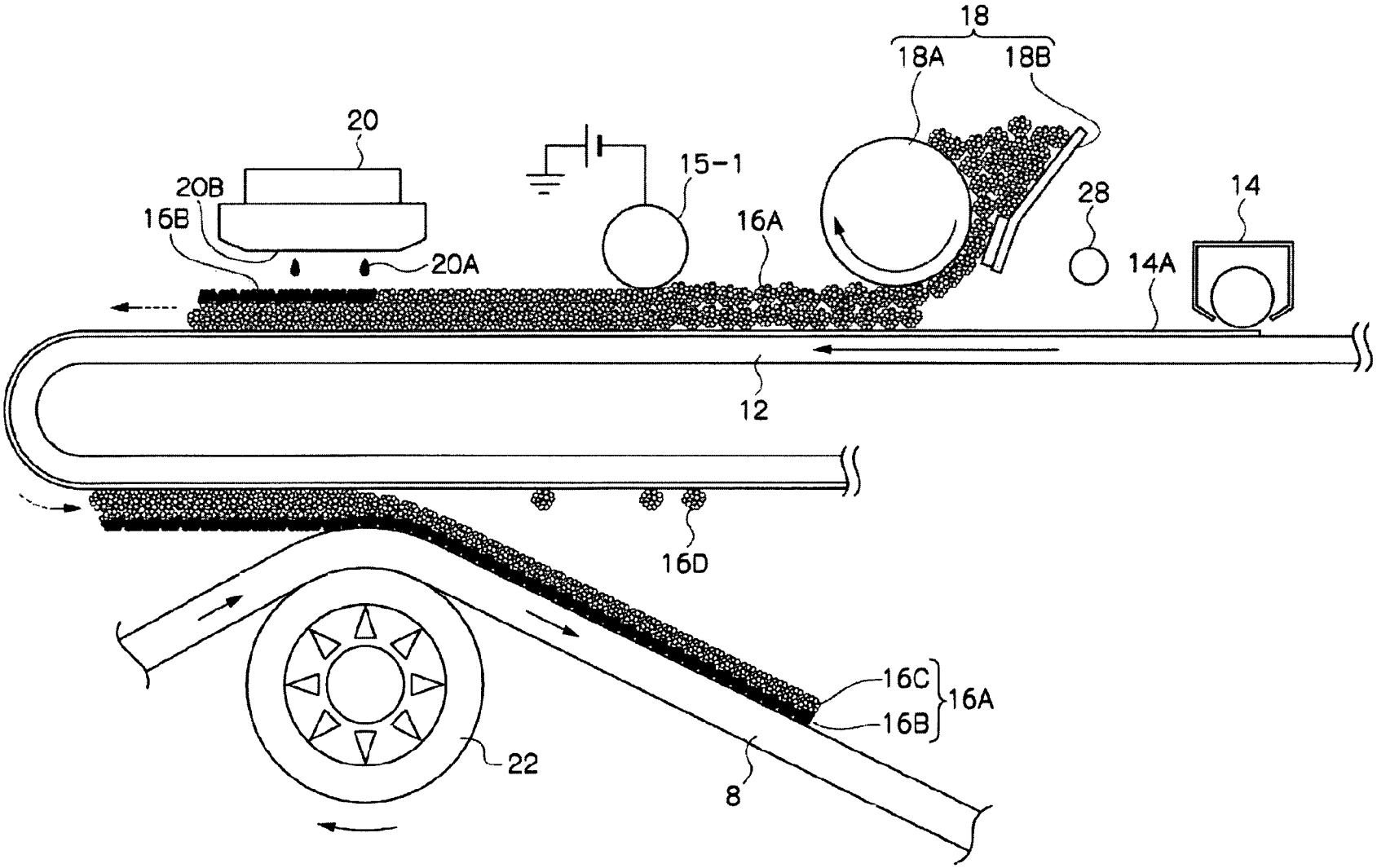
FIG. 2 is a schematic diagram showing a main part of the recording device according to the first exemplary embodiment.

FIG. 1 is a schematic diagram showing a recording device according to the first embodiment. FIG. 2 is a schematic diagram showing a main part of the recording device according to the first embodiment. FIG. 3 is a schematic diagram showing an ink receiving particle layer according to the first embodiment. In the first embodiment, explanation will be given according to a case where composite particles are used as the ink receiving particles described later.

Referring to FIGS. 1 and 2, a recording device 10-1 according to the first embodiment typically includes an intermediate transfer body 12 in the form of an endless belt, a charger 28 that charges the surface of the intermediate transfer body 12, a particle feeder 18 that feeds ink receiving particles 16 onto the charged area on the intermediate transfer body 12 to form a particle layer, a pressure applying unit 15-1 for applying a pressure to the particle layer, an inkjet recording head 20 that ejects ink droplets onto the particle layer to form an image, and a transfer fixing unit 22 that transfers and fixes the ink receiving particle layer onto a recording medium 8 by allowing the intermediate transfer body 12 to contact the recording medium 8 and applying pressure and heat thereto. An ink receiving particle storing cartridge 19 is detachably connected to the particle feeder 18 via a feed pipe 19A.

A release agent feeder 14 that feeds a release agent 14D to form a release layer 14A is placed upstream of the charger 28.

The particle feeder 18 forms a layer of the ink receiving particles 16 on the surface of the intermediate transfer body 12 on which a charge is formed by the charger 28. Ink droplets of the respective colors are ejected onto the particle layer from the inkjet recording head 20 including the parts 20K, 20C, 20M, and 20Y for respective colors, thereby forming a color image.

The particle layer having the color image on its surface is transferred to the recording medium 8 by means of the transfer fixing unit (transfer fixing roll) 22 together with the color image. A cleaner 24 is placed downstream of the transfer fixing unit 22, which is for removing the residual ink receiving particles 16 on the surface of the intermediate transfer body 12 and other foreign materials adhered to the intermediate transfer body (such as paper powder from the recording medium 8).

The recording medium 8 having the transferred color image is fed out as is, and a charge is formed again on the surface of the intermediate transfer body 12 by the charger 28. In this process, the ink receiving particles transferred onto the recording medium 8 absorb and retain the ink droplets 20A, thereby enabling rapid feeding out.

If necessary, a charge remover 29 for removing the charge left on the surface of the intermediate transfer body 12 may be placed between the cleaner 24 and the release agent feeder 14 (hereinafter, the phrase "between A and B" suggests a space including neither A nor B, unless otherwise stated).

In this embodiment, the intermediate transfer body 12 includes a surface layer of about 400 μm-thick ethylene-propylene rubber (EPDM) formed on a base layer of an about 1 mm-thick polyimide film. This structure preferably has a surface resistance of about $10^{13}$ Ω/square and a volume resistivity of about $10^{12}$Ω·cm (semiconductivity).

When the intermediate transfer body 12 is rotated, the release agent layer 14A is formed first on the surface of the intermediate transfer body 12 by the release agent feeder 14. The release agent 14D is supplied onto the surface of the intermediate transfer body 12 by a feed roll 14C of the release agent feeder 14, and the thickness of the release agent layer 14A is determined by a blade 14B.

This structure may be such that the release agent feeder 14 is continuously in contact with the intermediate transfer body 12 for the purpose of continuously performing image formation and printing, or that the release agent feeder 14 is placed apart from the intermediate transfer body 12.

The release agent 14D may be supplied from an independent liquid supply system (not shown) to the release agent feeder 14 to ensure continuous supplying of the release agent 14D.

A positive charge is then applied onto the surface of the intermediate transfer body 12 by the charger 28 so that the surface of the intermediate transfer body 12 is positively charged. In this process, no more than a degree of an electric potential is required that enables supplying and adsorption of the ink receiving particles 16 onto the surface of the intermediate transfer body 12, by an electrostatic force that can be generated between a feed roll 18A of the particle feeder 18 and the surface of the intermediate transfer body 12.

In this embodiment, the device has such a structure that a voltage is applied in between the charger 28 and a driven roll 31 (connected to the ground) placed opposite to the charger 28 via the intermediate transfer body 12, using the charger 28, thereby charging the surface of the intermediate transfer body 12.

The charger 28 is a roll-shaped component that includes a bar-shaped stainless steel material and an elastic layer in which an electrical conductivity-imparting material is dispersed (a urethane foam resin) formed on the outer periphery of the bar-shaped material having the volume resistivity controlled to be from about $10^6$Ω·cm to about $10^8$Ω·cm. In addition, the surface of the elastic layer is covered with a water- and oil-repellant coating layer (for example, made of a tetrafluoroethylene-perfluoroalkyl vinyl ether copolymer (PFA)) to a thickness of about 5 μm or more and about 100 μm or less.

The charger 28 is connected to a DC power source, and the driven roll 31 is electrically connected to the frame ground. The charger 28 is driven while holding the intermediate transfer body 12 between the driven roll 31 and the charger 28. At the pressing site, a predetermined degree of potential difference is generated between the charger 28 and the grounded driven roll 31, by which the surface of the intermediate transfer body 12 can be charged. In this embodiment, for example, the surface of the intermediate transfer body 12 is charged by applying a voltage of about 1 kV onto the surface of the intermediate transfer body 12 by the charger 28.

The charger 28 may include a corotron or the like.

The ink receiving particles 16 are then fed from the particle feeder 18 to the surface of the intermediate transfer body 12 to form an ink receiving particle layer 16A. The particle feeder 18 includes, in a vessel storing the ink receiving particles 16, a feed roll 18A placed opposite to the intermediate transfer body 12 and a charging blade 18B placed so as to press the feed roll 18A. The charging blade 18B also have the function of controlling the thickness of the layer of ink receiving particles 16 to be supplied onto the surface of the feed roll 18A.

When the ink receiving particles 16 are supplied to the feed roll 18A (conductive roll), the ink receiving particle layer 16A is controlled by the charging blade 18B (conductive blade) and negatively charged, i.e., the polarity being opposite to that of the charge on the surface of the intermediate transfer body 12. an aluminum solid roll may be used as the feed roll 18A, and a metal plate (such as a SUS plate) with a urethane rubber for pressing may be used as the charging blade 18B. The charging blade 18B is brought into contact with the feed roll 18A by a doctor blade method.

The charged ink receiving particles 16 form a particle layer consisting of, for example, a single layer, on the surface of the feed roll 18A and are delivered to a site opposite to the surface of the intermediate transfer body 12, and transferred onto the surface of the intermediate transfer body 12 by the electrostatic force, by the electric field generated by the potential difference between the feed roll 18A adjacent to the above site and the surface of the intermediate transfer body 12.

In this process, the traveling speed of the intermediate transfer body 12 and the rotating speed of the feed roll 18A (the peripheral speed ratio) are relatively set such that a single layer of particles is formed on the surface of the intermediate transfer body 12. The peripheral speed ratio depends on the amount of the charge on the intermediate transfer body 12, the amount of the charge on the ink receiving particles 16, the positional relationship between the feed roll 18A and the intermediate transfer body 12, or other parameters.

By relatively increasing the peripheral speed of the feed roll 18A with reference to the peripheral speed ratio at which a single ink receiving particle layer 16A is formed, the number of the particles supplied onto the intermediate transfer body 12 can be increased. If the density of the image to be transferred is low (the ejecting amount of the ink is small; for example, about 0.1 g/m$^2$ or more and about 1.5 g/m$^2$ or less), the layer thickness is preferably minimized; for example, about 1 μm or more and about 5 μm or less). If the image density is high (the ejection amount of the ink is large; for example, about 4 g/m$^2$ or more and about 15 g/m$^2$ or less), the layer thickness is preferably controlled to a sufficient level for retaining a liquid ink component, e.g., a solvent or a dispersion medium (for example, about 10 μm or more and about 25 μm or less).

For example, in a case where a character or image is printed with a small ejecting amount of the ink, when an image is formed onto a single ink receiving particle layer on the intermediate transfer body, the image-forming material (pigment) in the ink is trapped by the surface of the ink receiving particle layer on the intermediate transfer body and fixed on the surface of the ink receiving particles or in the internal particle voids, in order that the distribution of the ink in the depth direction is reduced.

Figure 3A:
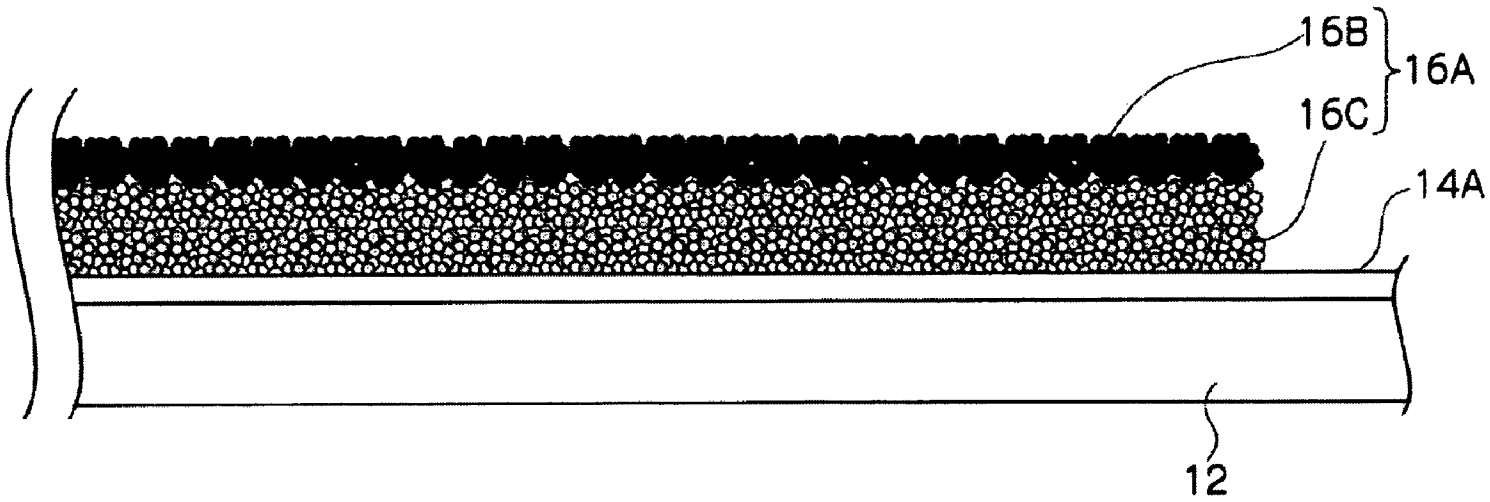
FIGS. 3A and 3B are schematic diagrams showing an ink receiving particle layer according to the first exemplary embodiment.
Figure 3B:
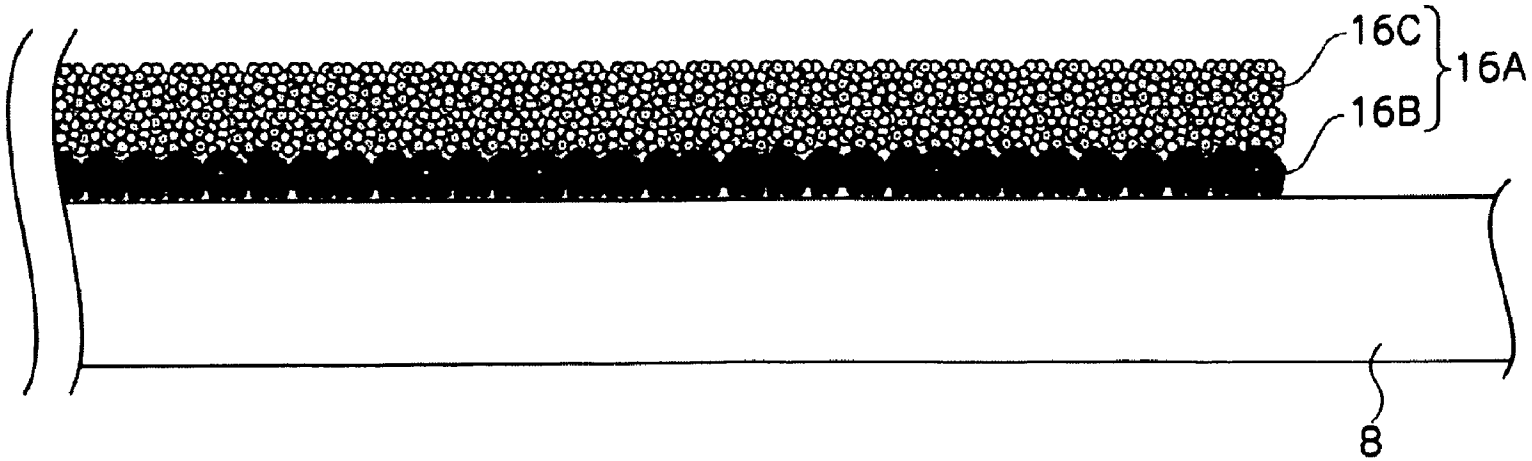

For example, when a particle layer 16C is provided as a protective layer on an image layer 16B that eventually becomes an image, by forming the ink receiving particle layer 16A to a thickness of about three layers and forming an image on the uppermost layer with ink (see FIG. 3A), a particle layer 16C consisting of the two layers not involved in image formation is formed on the image layer 16B as a protective layer after transfer and fixation (see FIG. 3B).

When an image is formed with a large ejecting amount of ink, such as an image of two or three colors, the ink receiving particles 16 are layered so that there are enough particles to retain a liquid ink component (e.g., a solvent or a dispersion medium), thereby trapping the recording material (e.g., a pigment) so that the material does not reach the lowermost layer. In this case, the ink receiving particles 16 that does not undergo image formation may form a protective layer on the surface of the image such that the image-forming material (pigment) is not exposed on the surface of the image layer after transfer and fixation.

The pressure applying unit 15-1 then applies pressure onto the ink receiving particle layer 16A from the surface side of the particle layer. In this embodiment, a pressing roll is used as the pressure applying unit 15-1, and pressure is applied by pressing the pressing roll against the surface side of the ink receiving particle layer 16A.

The inkjet recording head 20 then applies ink droplets 20A onto the ink receiving particle layer 16A. The inkjet recording head 20 applies the ink droplets 20A onto a specified location according to the given image information.

Finally, the recording medium 8 and the intermediate transfer body 12 are nipped by the transfer fixing unit 22 to apply pressure and heat to the ink receiving particle layer 16A, and the ink receiving particle layer 16A is transferred onto the recording medium 8.

The transfer fixing unit 22 includes a heating roll 22A containing a heat source and a pressing roll 22B placed opposite to the heating roll 22A via the intermediate transfer body 12 interposed therebetween, wherein the heating roll 22A and the pressing roll 22B are in contact with each other to form a contact portion. As the heating roll 22A and the pressing roll 22B, an aluminum core coated with a silicone rubber and further coated with a PFA tube can be used.

At the contact portion between the heating roll 22A and the pressing roll 22B, the ink receiving particle layer 16A is heated by a heater and pressure is applied, and then the ink receiving particle layer 16A is transferred and fixed onto the recording medium 8.

In this process, organic resin particles that constitute the ink receiving particles 16 in the non-image area are heated to a temperature of not less than the glass transition temperature (Tg) to be softened (or melted), and the ink receiving particle layer 16A is released from the release layer 14A formed on the surface of the intermediate transfer body 12 by pressure, and transferred and fixed onto the recording medium 8. In this process, the transfer fixing ability is increased by heating. In this embodiment, the temperature of the surface of the heating roll 22A is controlled to be about 160° C. In this process, the liquid ink component (a solvent or a dispersion medium) is still retained in the ink receiving particle layer 16A and fixed even after the transfer. Further, the intermediate transfer body 12 may be preheated before the transfer fixing unit 22.

Any kind of permeable medium (such as standard paper and inkjet coated paper) or impermeable medium (such as art paper and resin films) may be used as the recording medium 8. The recording medium is not limited to the above and may include other industrial products such as semiconductor substrates.

The process of forming an image in the recording device 10-1 according to this embodiment will be described in more detail below. Referring to FIG. 2, the release layer 14A can be formed on the surface of the intermediate transfer body 12 by the release layer feeder 14 in the recording device 10-1 according to this embodiment. When the base material of the intermediate transfer body 12 is aluminum or PET, formation of the release layer 14A is particularly preferred. Alternatively, the surface of the intermediate transfer body 12 in itself may be imparted with releasability by using a fluororesin or a silicone rubber-based material.

The surface of the intermediate transfer body 12 is then charged by the charger 28 to have a polarity opposite to that of the ink receiving particles 16. Thus, the ink receiving particles 16 supplied from the feed roll 18A of the particle feeder 18 can be electrostatically adsorbed to form a layer of the ink receiving particles 16 on the surface of the intermediate transfer body 12.

The layer of ink receiving particles 16 are then formed on the surface of the intermediate transfer body 12 by means of the feed roll 18A of the particle feeder 18. For example, the ink receiving particle layer 16A is formed to have a thickness of about three layers of the ink receiving particles 16. Specifically, the thickness of the ink receiving particle layer 16A is controlled to the desired value by the gap between the feed roll 18A and the charging blade 18B to control the thickness of the ink receiving particle layer 16A to be transferred to the recording medium 8. Alternatively, the thickness may be controlled by the ratio between the peripheral speeds of the feed roll 18A and the intermediate transfer body 12.

The pressing roll of the pressure applying unit 15-1 is pressed against the front side of the formed ink receiving particle layer 16A to apply a pressure to the ink receiving particle layer 16A.

For example, the pressing roll provided as the pressure applying unit 15-1 is rotatably provided between the particle feeder 18 and the inkjet recording head 20 and supported in a movable manner in a direction opposite to the outer surface of the intermediate transfer body 12.

When the ink receiving particle layer 16A supplied onto the intermediate transfer body 12 is transported to the position under the pressing roll by the rotation thereof, the layer 16A is inserted into the region where the pressing roll and the intermediate transfer body 12 face each other. Thus, the ink receiving particle layer 16A is pressed from the surface side thereof by the weight of the rotating pressing roll.

The pressing roll provided as the pressure applying unit 15-1 may also be supported and fixed by a spring member or the like so that a predetermined pressure is applied in the direction of the ink receiving particle layer 16A.

When a pressure is applied onto the ink receiving particle layer 16A, excess voids in the particle layer are reduced, and each of the ink receiving particles 16 are deformed to make the voids among the particles smaller, thereby increasing the density of the particles in the ink receiving particle layer 16A. In addition, if the ink receiving particles 16 constitute composite particles, each of the composite particles decomposes into each component particles with which excess voids in the particle layer 16A are filled, thereby increasing the density of the particles in the ink receiving particle layer 16A.

If the density of the particles in the ink receiving particle layer 16A is increased to make the size of the voids among the particles smaller, the liquid absorbing power (i.e., capillary force) generated by the voids among the particles can be increased, therefore improving the capability of the voids between the particles to retain the ink therein.

By applying pressure by the pressure applying unit 15-1, variation in the thickness of the ink receiving particle layer 16A can be suppressed (surface irregularity of the particle layer can be smoothed), unevenness in image quality or glossiness can be reduced, and variation in the size of the voids among the particles in the layer can be suppressed, so that the ink can readily-stay in the region where it has been applied, thereby suppressing the spreading of the ink.

In this process, the pressure to be applied by the pressure applying unit 15-1 is preferably about $10^3$ Pa or more and about $10^7$ Pa or less, more preferably about $10^5$ Pa or more and about $10^7$ Pa or less, and still more preferably about $10^5$ Pa or more and about $10^6$ Pa or less.

Further, a voltage is applied to the pressing roll as the pressure applying unit 15-1 such that the surface of the pressing roll in contact with the ink receiving particle layer 16A is charged to have the same polarity as that of the ink receiving particles 16. Specifically, when the ink receiving particles 16 are negatively charged, the pressure applying unit 15-1 is also negatively charged, or when the ink receiving particles 16 are positively charged, the pressure applying unit 15-1 is also positively charged.

When a voltage is applied to charge in the above manner, the pressure applying unit 15-1 applies pressure to the ink receiving particle layer 16A, by which electrostatic repulsion is caused at the time of contact between the surface of the pressure applying unit 15-1 and the ink receiving particles 16.

The ink droplets 20A are then ejected onto the pressure-applied ink receiving particle layer 16A by the inkjet recording head 20 of respective colors driven in a piezoelectric mode, a thermal mode or the like, to form the image layer 16B on the ink receiving particle layer 16A. The ink droplets 20A are ejected from the inkjet recording head 20 into the ink receiving particle layer 16A. The liquid component of the ink is rapidly absorbed into the voids among the ink receiving particles 16 and into the voids constituting the ink receiving particles 16, and at the same time, the recording materials (such as pigments) are also trapped on the surface of the ink receiving particles 16 (constituent particles) or in the interparticle voids constituting the ink receiving particles 16.

In this process, while the ink liquid component (a solvent or a dispersion medium) in the ink droplets 20A infiltrates into the ink receiving particle layer 16A, the recording materials such as a pigment are trapped on the surface of the ink receiving particle layer 16A or in the interparticle voids. In other words, the ink liquid component (a solvent or a dispersion medium) may be allowed to pass through to the back side of the ink receiving particle layer 16A, whereas the recording materials such as a pigment do not pass through to the back side of the ink receiving particle layer 16A. Thus, in the process of transfer to the recording medium 8, a particle layer 16C that is not impregnated with the recording materials such as a pigment is formed on an image layer 16B. As a result, the particle layer 16C forms a protective layer to seal the surface of the image layer 16B so that an image having a surface on which no recording material is exposed can be formed.

The ink receiving particle layer 16A having the image layer 16B formed thereon is then transferred and fixed from the intermediate transfer body 12 onto the recording medium 8 so that a color image is formed on the recording medium 8. The ink receiving particle layer 16A on the intermediate transfer body 12 is heated and pressed by the transfer fixing unit 22 (a transfer fixing roll) heated by a heating means such as a heater, then transferred onto the recording medium 8.

In this process, the surface irregularities of the image and the glossiness may be regulated by controlling heating and pressing. Alternatively, the glossiness can be controlled by performing cool separation.

After the ink receiving particle layer 16A has been separated, residual particles 16D on the surface of the intermediate transfer body 12 are collected by the cleaner 24 (see FIG. 1), and the surface of the intermediate transfer body 12 is charged again by the charger 28, and the ink receiving particles 16 are supplied to form an ink receiving particle layer 16A.

FIG. 3 shows particle layers used in the image formation according to the invention. As shown in FIG. 3A, the release layer 14A is formed on the surface of the intermediate transfer body 12.

The ink receiving particles 16 is then formed into a layer or layers on the surface of the intermediate transfer body 12 by the particle feeder 18. As described above, the ink receiving particles 16 are preferably stacked in about three layers in the thickness direction of the ink receiving particle layer 16A. The thickness of the ink receiving particle layer 16A to be transferred onto the recording medium 8 is controlled by controlling the ink receiving particle layer 16A to have the desired thickness. In this process, the surface of the ink receiving particle layer 16A is smoothed to such a degree that the image formation (the formation of the image layer 16B) by the ejection of the ink droplets 20A undergoes no harmful effect.

As shown in FIG. 3A, from about ⅓ to about half in thickness of the ink receiving particle layer 16A is impregnated with a recording material such as a pigment contained in the ejected ink droplets 20A, and under the ink receiving particle layer 16A remains the particle layer 16C impregnated with no recording material such as a pigment.

As shown in FIG. 3B, the ink receiving particle layer 16A formed on the recording medium 8 by heat/press transfer at the transfer fixing unit (transfer fixing roll) 22 includes the image layer 16B and the ink-free particle layer 16C on the image layer 16B, and the layer 16C serves as a kind of protective layer to prevent the image layer 16B from being directly exposed on the surface. Therefore, the ink receiving particles 16 needs to be transparent at least after the fixing.

The particle layer 16C is heated and pressed by the transfer fixing unit (transfer fixing roll) 22 so that its surface can be smoothed, and also the glossiness of the image surface can be controlled by heating or pressing.

Further, evaporation of the liquid ink component (a solvent or a dispersion medium) trapped in the ink receiving particles 16 may be enhanced by heating.

The liquid ink component (a solvent or a dispersion medium) received and retained in the ink receiving particle layer 16A is still maintained in the ink receiving particle layer 16A even after the transfer and fixing, and then removed by air drying.

The image formation is completed through the above described processes. When the residual particles 16D and foreign materials such as paper powder released from the recording medium 8 are left on the intermediate transfer body 12 after the ink receiving particles 16 have been transferred onto the recording medium 8, they may be removed by the cleaner 24.

A charge remover 29 may also be provided downstream of the cleaner 24. For example, by using a semiconductive or conductive roll as the charge remover 29, the surface of the intermediate transfer body 12 is electrically neutralized by nipping the intermediate transfer body 12 in between the charge remober 29 and the driven roll 31 (grounded), and applying a voltage of about ±3 kV at about 500 Hz to the surface of the intermediate transfer body 12.

The charging voltage, the thickness of the particle layer, the fixing temperature and other various conditions for the device may be optimized, respectively, depending on the composition of the ink receiving particles 16 or the ink, the amount of the ink to be ejected, and the like.

<Constituent Elements>

Constituent elements for each step of the embodiment will be described in detail below.

<Intermediate Transfer Body>

The intermediate transfer body 12 on which the ink receiving particle layer is formed may be in the form of a belt as shown in the embodiment, or in the form of a cylinder (a drum). In order to supply and retain the ink receiving particles on the surface of the intermediate transfer body by electrostatic force, the outer surface of the intermediate transfer body needs to have semiconducting or insulating particle-retention properties. When the electrical properties of the surface of the intermediate transfer body is semiconductive, a material with a surface resistance of about $10^{10}\Omega$/square or more and about $10^{14}\Omega$/square or less and a volume resistivity of about $10^{9}\Omega\cdot$cm or more and about $10^{13}\Omega\cdot$cm or less is used, and when the electrical properties of the surface of the intermediate transfer body is insulating, a material with a surface resistance of about $10^{14}\Omega$/square or more and a volume resistivity of about $10^{13}\Omega\cdot$cm or more can be used.

When the intermediate transfer body is in the form of a belt, any material can be used for the base material, as long as the material enables the rotation of the belt in the device and has necessary mechanical strength, and optionally has necessary heat resistance particularly in the case where heat is used for transfer and fixing. Specifically, polyimide, polyamideimide, aramid resins, polyethylene terephthalate, polyester, polyethersulfone, stainless steel, or the like may be used.

When the intermediate transfer body is in the form of a drum, the base material may be aluminum, stainless steel or the like.

When the heating method is performed by electromagnetic induction in the fixing process with the transfer fixing unit (transfer fixing roll) 22, a heat generating layer may be formed on the intermediate transfer body 12 instead of on the transfer fixing unit (transfer fixing roll) 22. A metal capable of causing electromagnetic induction may be used for the heat generating layer, which may be selected from nickel, iron, copper, aluminum, chromium, and the like.

<Particle Supply Process>

Prior to supplying of the ink receiving particles 16, the release layer 14A is formed with the release agent 14D on the surface of the intermediate transfer body 12 by the release agent feeder 14.

The release layer 14A may be formed by a method including feeding of the release agent 14D from a release agent supply part storing the release agent 14D to the surface of the intermediate transfer body 12 to form the release layer 14A, or by a method including forming of the release layer 14A on the surface of the intermediate transfer body 12, using a supplying member impregnated with the release agent 14D.

The release agent 14D may be silicone oils, fluorochemical oils, polyalkylene glycols, surfactants, or any other releasing materials.

Examples of the silicon oils include straight silicone oil and modified silicone oil.

Examples of the straight silicone oil include dimethyl silicone oil and methyl hydrogen silicone oil.

Examples of the modified silicone oils include methyl styryl-modified oil, alkyl-modified oil, higher fatty acid ester-modified oil, fluorine-modified oil, and amino-modified oil.

Examples of the polyalkylene glycols include polyethylene glycol, polypropylene glycol, ethylene oxide-propylene oxide copolymers, and polybutylene glycol. Among these, polypropylene glycol is particularly preferable.

Examples of the surfactants include anionic surfactants, cationic surfactants, amphoteric surfactants, and nonionic surfactants. Among them, nonionic surfactants are particularly preferable.

For example, the viscosity of the release agent 14D is preferably about 5 mPa·s or more and about 200 mPa·s or less, more preferably about 5 mPa·s or more and about 100 mPa·s or less, and still more preferably about 5 mPa·s or more and about 50 mPa·s or less.

The viscosity may be measured as described below. Rheomat 115 (manufactured by Contraves) is used as a measuring system to determine the viscosity of the resulting ink. The sample is placed in the measurement container and mounted on the device by the given method, and the measurement is performed under the conditions of a measurement temperature of about 40° C. and a shear rate of about 1400 $s^{-1}$.

For example, the surface tension of the release agent 14D may be about 40 mN/m or less, preferably about 30 mN/m or less, and more preferably about 25 mN/m or less.

The measurement of the surface tension is performed on the resulting sample using a Wilhelmy-type surface tension meter (manufactured by Kyowa Interface Science Co., Ltd.) in an environment at about 23±0.5° C. and about 55±5% RH.

For example, the boiling point of the release agent 14D under 760 mmHg may be about 250° C. or more, preferably about 300° C. or more, and more preferably about 350° C. or more.

The boiling point may be measured according to JIS K 2254 (the disclosure of which is incorporated herein by reference), and the initial boiling point is used as the boiling point.

The surface of the intermediate transfer body 12 is then charged by the charger 28 to have a polarity opposite to that of the ink receiving particles 16. The ink receiving particle layer 16A is then formed on the surface of the charged intermediate transfer body 12. In this process, known methods of supplying an electro-photographic toner onto a photoreceptor can be applied to the method for forming the ink receiving particle layer 16A. Specifically, a charge may be supplied in advance to the surface of the intermediate transfer body 12 by a common electro-photographic charging method (such as a method of charging with a charger 28). The ink receiving particles 16 may be charged by friction (a single- or two-component frictional charging method) to have a polarity opposite to that of the charge on the surface of the intermediate transfer body 12.

The ink receiving particles 16 held on the feed roll 18A form an electric field together with the surface of the intermediate transfer body 12 and are transferred and supplied onto the intermediate transfer body 12, and retained there by electrostatic force. In this process, the thickness of the ink receiving particle layer 16A may be controlled depending on the thickness of the image layer 16B to be formed in the ink receiving particle layer 16A (depending on the amount of the ink to be ejected). In this process, the absolute value of the amount of the charge of the ink receiving particles 16 is preferably in the range of about 5 μc/g or more and about 50 μc/g or less.

In this process, the thickness of the ink receiving particle layer 16A is preferably about 1 μm or more and about 100 μm or less, more preferably about 1 μm or more and about 50 μm or less, and still more preferably about 5 μm or more and about 25 μm or less. The porosity of the ink receiving particle layer (i.e., the sum of the void ratio in the ink receiving particles and the void ratio in the ink receiving particles (trap structure)) is preferably about 10% or more and about 80% or less, more preferably about 30% or more and about 70% or less, and still more preferably about 40% or more and about 60% or less.

Here, a particle supply process corresponding to a single-component supply (development) method will be described.

The ink receiving particles 16 are supplied to the feed roll 18A, then charged and the thickness thereof is controlled by the charging blade 18B.

The charging blade 18B has a function to control the thickness of the layer of the ink receiving particles 16 on the surface of the feed roll 18A. For example, the charging blade 188B changes the thickness of the layer of the ink receiving particles 16 on the surface of the feed roll 18A by changing the pressure applied on the feed roll 18A. For example, a layer of the ink receiving particles 16 may be formed to have a monolayer thickness on the surface of the feed roll 18A so that a layer of the ink receiving particles 16 can be formed to have an approximately monolayer thickness on the surface of the intermediate transfer body 12. Alternatively, the pressing force of the charging blade 18B may be controlled to be low so that the thickness of the layer of the ink receiving particles 16 formed on the surface of the feed roll 18A can be increased, and thus the thickness of the ink receiving particle layer formed on the surface of the intermediate transfer body 12 can be increased.

In another method, for example, when the peripheral speeds of the feed roll 18A and the intermediate transfer body 12 which allow the formation of a particle monolayer on the surface of the intermediate transfer body 12 are normalized as 1, the thickness of the ink receiving particle layer on the intermediate transfer body 12 can be controlled to increase, by increasing the amount of the ink receiving particles 16 supplied onto the intermediate transfer body 12 by increasing the peripheral speed of the feed roll 18A. The above methods may also be combined for the control. In the above processes, for example, the ink receiving particles 16 are negatively charged, while the surface of the intermediate transfer body 12 is positively charged.

By controlling the thickness of the ink receiving particle layer in such a manner, a pattern having the surface thereof coated with a protective layer can be formed with the suppressed amount of consumption of the ink receiving particles.

The charging roll of the charger 28 may be a roll having a diameter of about 10 mm or more and about 25 mm or less and including a bar- or pipe-shaped member made of aluminum, stainless steel or the like, the member having an elastic layer formed on the outer surface of the member containing a dispersed conductivity-imparting material therein, wherein a volume resistivity thereof is controlled to be about $10^6\Omega\cdot$cm or more and about $10^8\Omega\cdot$cm or less.

The elastic layer can be formed using urethane resins, thermoplastic elastomers, epichlorohydrin rubbers, ethylene-propylene-diene copolymer rubbers, silicone rubbers, acrylonitrile-butadiene copolymer rubbers, polynorbornene rubbers, and any other resin materials. These materials may be used alone or in combination of two or more, and a urethane foam resin is preferably used.

In a preferred mode, the urethane foam resin is a urethane resin containing a hollow material such as hollow glass beads and thermally expandable microcapsules mixed and dispersed therein to have a closed cell structure.

The surface of the elastic layer may also be covered with a water-repellant coating layer with a thickness of about 5 μm or more and about 100 μm or less.

The charger 28 is connected to a DC power source, and the driven roll 31 is electrically connected to the frame ground. The charger 28 is driven while holding the intermediate transfer body 12 between the charger 28 and the driven roll 31 and it. At the pressing site, a predetermined potential difference is generated between the charger 28 and the grounded driven roll 31.

<Pressure Application Process>

The pressing roll provided as the pressure applying unit 15-1 is then pressed against the surface side of the formed ink receiving particle layer 16A to apply pressure to the ink receiving particle layer 16A, thereby increasing the density of the particles in the ink receiving particle layer 16A.

For example, a metal roll or an elastic roll including a metal shaft and an elastic layer formed thereon is preferably used for the pressing roll provided as the pressure applying unit 15-1.

For example, the metal roller may be made of stainless steel, aluminum, iron, or the like. In the elastic roller, for example, the metal shaft may be made of stainless steel, aluminum, iron, or the like, similarly to the above. On the other hand, the elastic layer may be made of a resin material or a rubber material. The elastic layer may also use a foamed material or contain a conductive agent so as to have electrical conductivity.

The surface of the pressing roll may also preferably be coated with a solid lubricant.

Examples of the resin materials include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, and styrene-butadiene resins.

Examples of the rubber materials include EPDM (ethylene-propylene-diene copolymer rubber), polybutadiene, natural rubber, polyisobutylene, SBR (styrene-butadiene copolymer rubber), CR (chloroprene rubber), NBR (acrylonitrile-butadiene copolymer rubber), silicone rubber, urethane rubber, epichlorohydrin rubber, SBS (styrene-butadiene-styrene copolymer rubber), thermoplastic elastomer, norbornene rubber, fluorosilicone rubber, ethylene oxide rubber, chloroprene rubber, isoprene rubber, and epoxy rubber.

The conductive agent may be an electron conductive agent or an ion conductive agent. Examples of the electron conductive agents include fine powders of carbon black such as Ketjenblack and acetylene black; pyrolytic carbon, graphite; conductive metals such as aluminum, copper, nickel, and stainless steel, and alloys thereof; conductive metal oxides such as tin oxide, indium oxide, titanium oxide, tin oxide-antimony oxide solid solution, and tin oxide-indium oxide solid solution; and insulating materials having a surface subjected to an electrically-conductive treatment. Examples of the ion conductive agents include perchlorates or chlorates such as tetraethylammonium and lauryl trimethyl ammonium; and perchlorates or chlorates of an alkali metal or alkali earth metal such as lithium and magnesium.

Examples of the solid lubricant include fluororesins such as PFA (tetraethylene-perfluoroalkyl vinyl ether copolymers), PTFE (polytetrafluoroethylene), FEP (tetrafluoroethylene-hexafluoropropylene copolymers), polytetrafluoroethylene (PTFE), and polyvinylidene fluoride (PVDF); and layered materials such as molybdenum disulfide, tungsten disulfide, cadmium iodide, lead iodide, molybdenum diselenide, graphite, graphite fluoride, and phthalocyanines.

The form of the pressure applying unit 15-1 is not limited to a roll, and may also be in the form of a blade or a belt. In the case of these forms, the above resin or rubber material may also be used to form a member in each form.

<Marking Process>

An image is formed by ejecting the ink droplets 20A from the inkjet recording head 20 onto the layer of the ink receiving particles 16 (ink receiving particle layer 16A) which has been formed on the surface of the intermediate transfer body 12 and pressed, according to an image signal. The ink droplets 20A are ejected into the ink receiving particle layer 16A from the inkjet recording head 20, and are rapidly absorbed into the interparticle voids formed in the ink receiving particles 16, while the recording material (such as a pigment) is trapped on the surface of the ink receiving particles 16 or in interparticle voids constituting the ink receiving particles 16.

In this case, it is preferred that a large amount of the recording material (such as a pigment) is trapped on the surface of the ink receiving particle layer 16A. The interparticle voids in the ink receiving particles 16 exhibit a filter effect so that the recording materials (such as pigments) are trapped on the surface of the ink receiving particle layer 16A and trapped and fixed in the interparticle voids in the ink receiving particles 16, when developed.

In order to ensure the trapping of the recording material (such as a pigment) on the surface of the ink receiving particle layer 16A and in the interparticle voids in the ink receiving particles 16, a method may be applied in which the ink is allowed to react with the ink receiving particles 16 to rapidly make the recording material (such as a pigment) insoluble (aggregate). Specifically, a reaction between the ink and a polyvalent metal salt or a pH reaction type may be applied to the above reaction.

The inkjet recording head is preferably a line-type inkjet recording head having a width equal to or larger than the width of the recording medium. However, an image may also be sequentially formed on a particle layer formed on an intermediate transfer body using a conventional scanning-type inkjet recording head. The ink ejecting means of the inkjet recording head 20 may be any means as long as it is capable of ejecting ink, such as a piezoelectric device driving type or a heating device driving type. Conventional inks containing a dye as a colorant may be used, but an ink containing a pigment is preferable.

<Transfer Process>

The ink receiving particle layer 16A having received the ink droplets 20A and having been formed an image is transferred and fixed onto the recording medium 8 so that the image is formed on the recording medium 8. The transfer and the fixing may be performed separately, but are preferably performed substantially simultaneously. The fixing may be performed by a method of heating the ink receiving particle layer 16*a* or a method of pressing it, or a method including both heating and pressing, but is preferably a method of performing heating and pressing substantially simultaneously.

By controlling the heating and pressing, physical properties of the surface of the ink receiving particle layer 16A and its glossiness can be controlled. After the heating and pressing, the recording medium 8 with the image (ink receiving particle layer 16A) transferred thereon may be separated from the intermediate transfer body 12 after the ink receiving particle layer 16A has been cooled. The cooling may be performed by natural cooling or forced cooling such as air cooling. For these processes, the intermediate transfer body 12 is preferably in the form of a belt.

The ink image is preferably formed on a surface part of the layer of the ink receiving particles 16 formed on the intermediate transfer body 12 (the recording material (pigment) is trapped on the surface of the ink receiving particle layer 16A) so that the ink image is protected by the particle layer 16C of the ink receiving particles 16, when transferred onto the recording medium 8.

The liquid ink component (a solvent or a dispersion medium) that has been received and retained by the layer of the ink receiving particles 16 is maintained in the layer of the ink receiving particles 16 even after the transfer and the fixing, and is then removed by air drying.

<Cleaning Process>

In order to refresh the surface of the intermediate transfer body 12 for repeated use, the process of cleaning the surface with the cleaner 24 is necessary. The cleaner 24 includes a cleaning part and a particle transferring and collecting part (not shown). The cleaning process includes removing of the ink receiving particles 16 (residual particles 16D) left on the surface of the intermediate transfer body 12 and removing deposits on the surface of the intermediate transfer body 12, such as foreign materials (paper powder from the recording medium 8 and the like) other than the particles. The collected residual particles 16D may be recycled.

<Charge-Removing Process>

The surface of the intermediate transfer body 12 may be subjected to charge removing using the charge remover 29 prior to formation of the release layer 14A.

In the recording device 10-1 according to this embodiment described above, the surface of the intermediate transfer body 12 is charged by the charger 28 after the release agent 14D has been supplied from the release agent feeder 14 to the surface of the intermediate transfer body 12 and the release layer 14A has been formed. The ink receiving particles 16 are then supplied from the particle feeder 18 to the region where the release layer has been formed and charged of the intermediate transfer body 12 to form the particle layer. The ink receiving particle layer 16A is then pressed by the pressure applying unit 15-1 to increase the particle density. Thereafter, ink droplets are ejected from the inkjet recording head 20 onto the particle layer to form an image, wherein the ink is received by the ink receiving particles 16. The recording medium 8 and the intermediate transfer body 12 are then placed onto each other, pressed and heated by the transfer fixing unit 22, and thus the ink receiving particle layer is transferred and fixed onto the recording medium 8.

Second Embodiment

Figure 4:
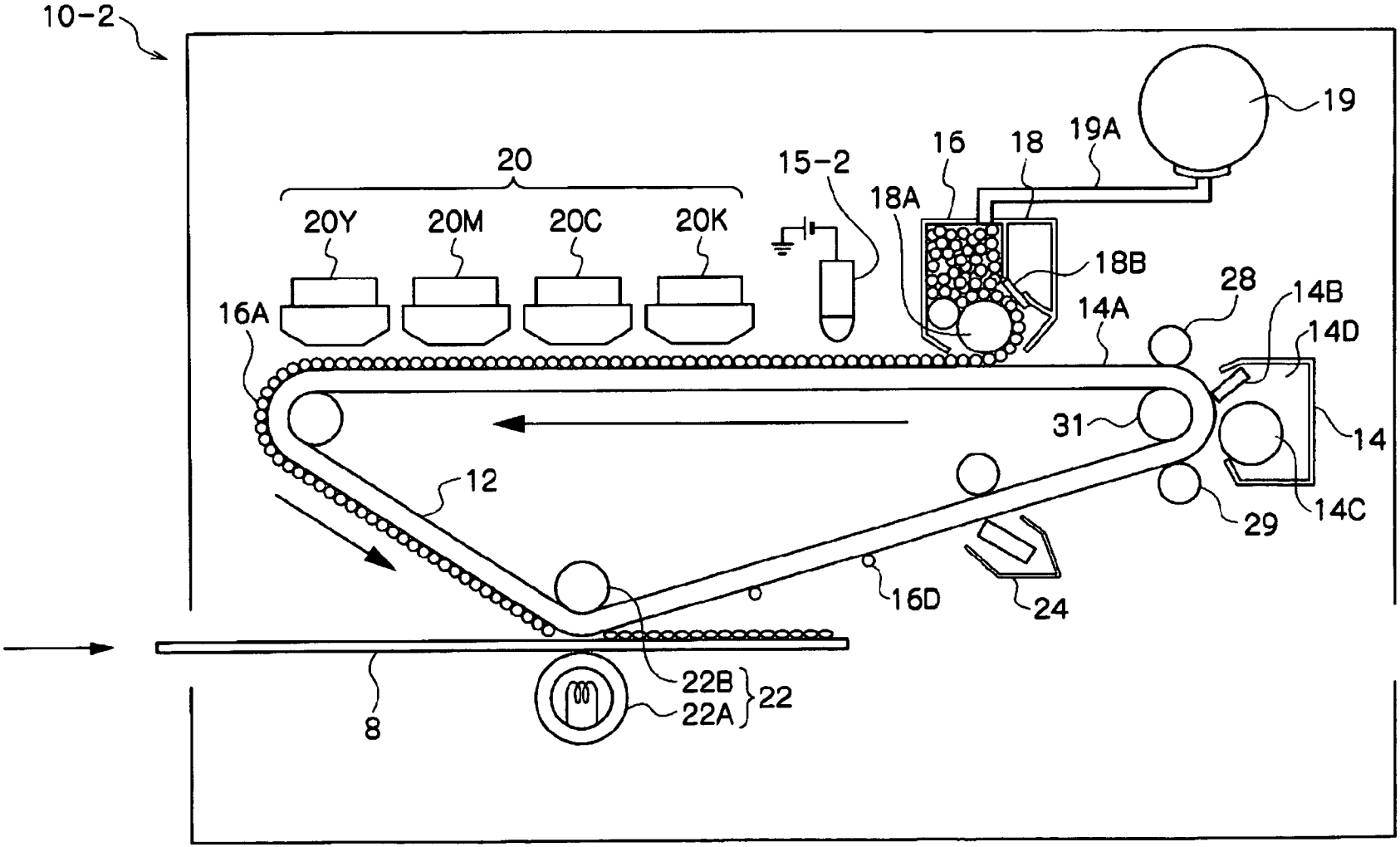
FIG. 4 is a schematic diagram showing a recording device according to a second exemplary embodiment.
Figure 5:
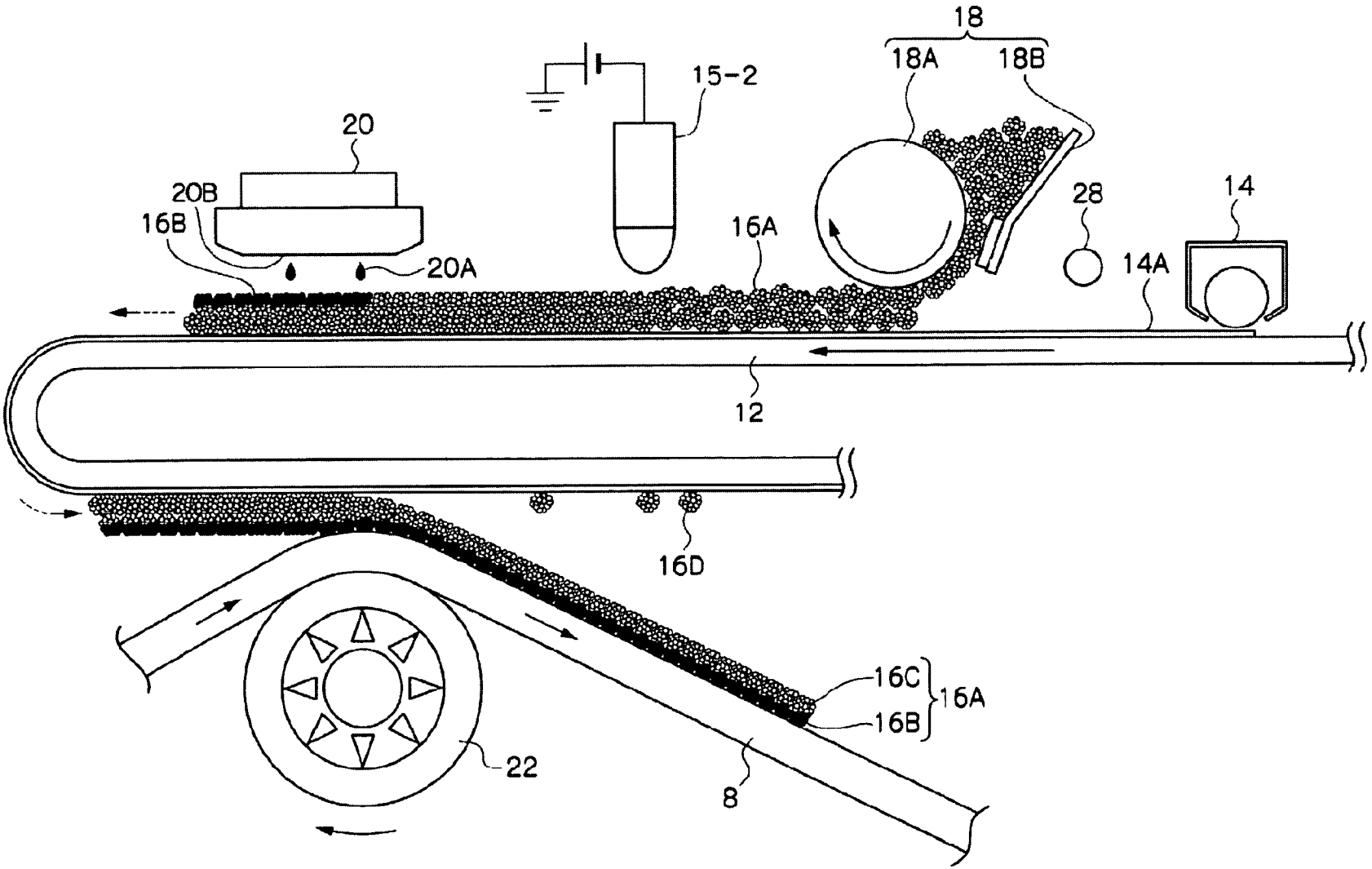
FIG. 5 is a schematic diagram showing a main part of the recording device according to the second exemplary embodiment.

FIG. 4 is a schematic diagram showing a recording device according to the second embodiment. FIG. 5 is a schematic diagram showing a main part of the recording device according to the second embodiment. In the second embodiment below, explanations are also given according to the case where composite particles as described later are used as the ink receiving particles.

As shown in FIGS. 4 and 5, the recording device 10-2 according to the second embodiment has a structure including a vibration applying unit 15-2 in place of the pressure applying unit 15-1 used in the first embodiment.

For example, a device including an ultrasonic vibrator for generating ultrasonic wave and a cabinet containing the vibrator can be used as the vibration applying unit 15-2. The ultrasonic vibrator may be a piezoelectric device (such as a lead zirconate titanate (PZT) device).

The vibration applying unit 15-2 may be placed opposite to the outer surface of the intermediate transfer body 12, wherein the unit may be in contact with the ink receiving particle layer 16A or not in contact therewith. Alternatively, the vibration applying unit 15-2 may be placed opposite to the inner surface of the intermediate transfer body 12, wherein the unit may be in contact or not in contact therewith. In this embodiment, the vibration applying unit 15-2 is provided not in contact with the ink receiving particle layer 16A and opposite to the outer surface of the intermediate transfer body 12.

When the ink receiving particle layer 16A supplied onto the intermediate transfer body 12 is delivered to the position under the vibration applying unit 15-2 by the rotation, ultrasonic vibration is applied from the vibration applying unit 15-2 to the ink receiving particle layer 16A.

Upon the application of the vibration, the particles in the ink receiving particle layer 16A are vibrated and excess voids in the ink receiving particle layer 16A are filled to make the size of the interparticle voids smaller, thereby increasing the density of the particles in the ink receiving particle layer 16A. Further, if the ink receiving particles 16 constitute composite particles, the composite particles are decomposed into individual particles, with which the excess voids in the particle layer 16A can be filled and thereby further increasing the density of the particles in the ink receiving particle layer 16A.

With the increase in the density of the particles in the ink receiving particle layer 16A and miniaturization of the voids among the particles, the liquid absorbing power (i.e., capillary force) generated by the interparticle voids can be increased, and the capability of the interparticle voids to retain ink can be increased.

Further, the application of vibration from the vibration applying unit 15-2 can reduce variation in the thickness of the ink receiving particle layer 16A, unevenness in image quality or unevenness in glossiness, and can also reduce variation in the size of the voids among the particles in the layer so that ink is readily retained in the region where the ink has been applied, thereby preventing the ink from spreading.

In this process, the vibration frequency generated by the vibration applying unit 15-2 is preferably in the range of about 2 kHz or more and about 100 kHz or less, more preferably in the range of about 5 kHz or more and about 50 kHz or less, and still more preferably in the range of about 10 kHz or more and about 40 kHz or less.

A voltage is also applied to the vibration applying unit 15-2 such that the surface in contact with the ink receiving particle layer 16A is charged to have the same polarity as that of the charge of the ink receiving particles 16. Specifically, when the ink receiving particles 16 are negatively charged, the vibration applying unit 15-2 is also negatively charged, or when the ink receiving particles 16 are positively charged, the vibration applying unit 15-2 is also positively charged.

When a voltage is applied to charge in such a manner, electrostatic repulsion is caused between the surface of the vibration applying unit 15-2 and the ink receiving particles 16, when vibration is applied from the vibration applying unit 15-2 to the ink receiving particle layer 16A.

The vibration applying unit 15-2 is not limited to a device containing an ultrasonic vibrator in a cabinet, and a tapping component such as an eccentric rotation component (for example, an eccentric cam) may also be used for the vibration applying unit 15-2. The tapping component is provided in contact with the ink receiving particle layer 16A and opposite to the intermediate transfer body 12, and directly applies vibration. When the tapping component is placed on the inner side of the intermediate transfer body 12, the component is provided in contact with the inner surface of the intermediate transfer body 12 and vibrates the intermediate transfer body 12, by which the ink receiving particle layer 16A is imparted with vibration.

Since the other elements are the same as those in the first embodiment, the descriptions thereof are omitted.

In the recording device 10-2 according to this embodiment described above, the surface of the intermediate transfer body 12 is charged by the charger 28 after the release agent 14D has been supplied from the release agent feeder 14 onto the surface of the intermediate transfer body 12 to form the release layer 14A. The ink receiving particles 16 are then supplied from the particle feeder 18 to the area in the intermediate transfer body 12 where the release layer has been formed and charged, thereby forming a particle layer. The ink receiving particle layer 16A is then vibrated by the vibration applying unit 15-2 to increase the particle density. Thereafter, ink droplets are ejected from the inkjet recording head 20 onto the particle layer to form an image, wherein the ink is received by the ink receiving particles 16. The recording medium 8 and the intermediate transfer body 12 are then placed onto each other, pressed and heated by the transfer fixing unit 22, and the ink receiving particle layer is transferred and fixed onto the recording medium 8.

Third Embodiment

Figure 6:
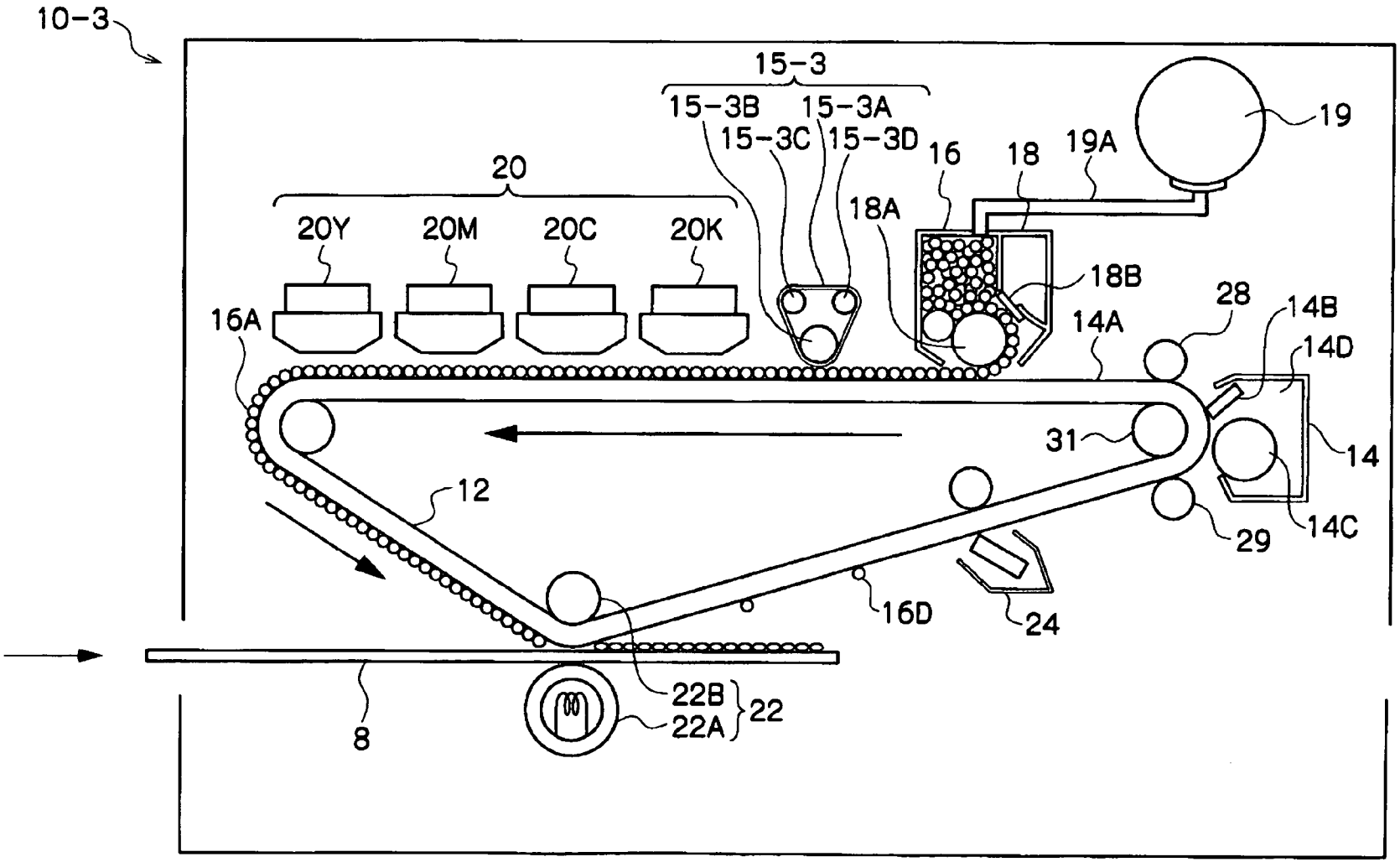
FIG. 6 is a schematic diagram showing a recording device according to a third exemplary embodiment.
Figure 7:
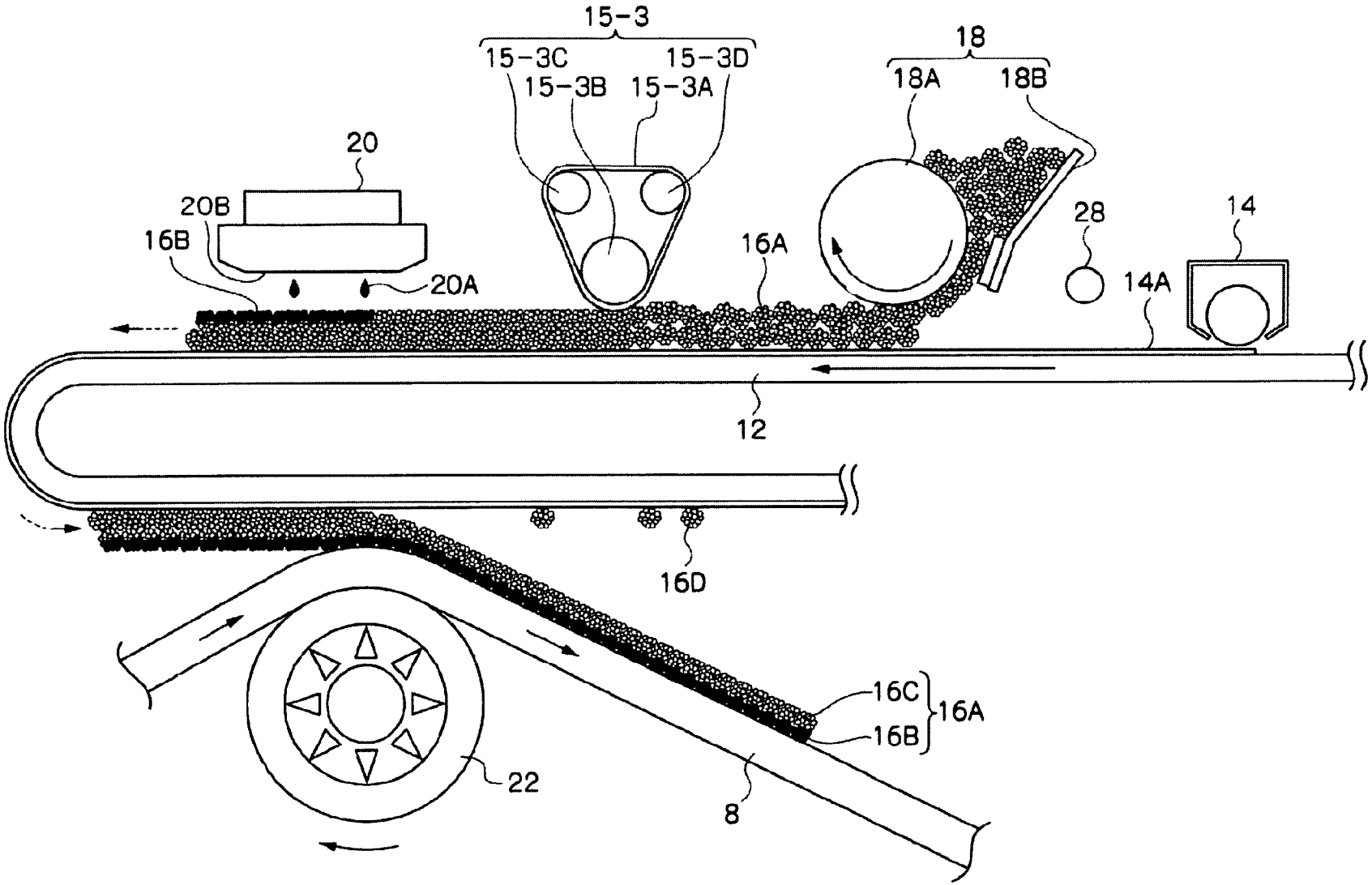
FIG. 7 is a schematic diagram showing a main part of the recording device according to the third exemplary embodiment.

FIG. 6 is a schematic diagram showing a recording device according to the third embodiment. FIG. 7 is a schematic diagram showing a main part of the recording device according to the third embodiment. In the third embodiment below, explanation will also be given according to the case where composite particles as described later are used as the ink receiving particles.

As shown in FIGS. 6 and 7, the recording device 10-3 according to the third embodiment has a structure including a pressure and vibration applying unit 15-3 for applying both pressure and vibration in place of the pressure applying unit 15-1 used in the first embodiment.

For example, the pressure and vibration applying unit 15-3 includes a pressing belt 15-3A placed opposite to the outer surface of the intermediate transfer body 12; an ultrasonic vibrator 15-3B placed on the inner side of the pressing belt 15-3A and opposite to the outer surface of the intermediate transfer body 12 via the pressing belt 15-3A; a driving roll 15-3C for rotating the pressing belt 15-3A from the inner side thereof; and a support roll 15-3D for supporting the pressing belt 15-3A from the inner side thereof.

The pressing belt 15-3A may be made of the resin or rubber material as described according to the pressure applying unit in the first embodiment, or other materials.

The ultrasonic vibrator 15-3B may be, for example, the vibration applying unit described in the second embodiment. A tapping component may also be used in place of the ultrasonic vibrator 15-3B similarly to the second embodiment.

The pressure and vibration applying unit 15-3 may be placed opposite to the outer surface of the intermediate transfer body 12, wherein the unit may be in contact with the ink receiving particle layer 16A or not in contact therewith. Alternatively, the pressure and vibration applying unit 15-3 may be provided opposite to the inner surface of the intermediate transfer body 12, wherein the unit may be in contact or not in contact therewith. In this embodiment, the pressure and vibration applying unit 15-3 is placed opposite to the outer surface of the intermediate transfer body 12 and not in contact with the ink receiving particle layer 16A.

When the ink receiving particle layer 16A supplied onto the intermediate transfer body 12 is delivered to the position under the pressure and vibration applying unit 15-3 by the rotation, pressure is applied from the pressing belt 15-3A to the ink receiving particle layer 16A, and ultrasonic vibration is also applied to the ink receiving particle layer 16A.

Since the other elements are the same as those in the first embodiment with the pressure applying unit and in the second embodiment with the vibration applying unit, the descriptions thereof are omitted here.

In the recording device 10-3 according to this embodiment described above, the release agent 14D is supplied from the release agent feeder 14 onto the surface of the intermediate transfer body 12 to form the release layer 14A, and the surface of the intermediate transfer body 12 is charged by the charger 28. The ink receiving particles 16 are then supplied from the particle feeder 18 to the area in the intermediate transfer body 12 where the release layer is formed and charged, thereby forming the particle layer. The ink receiving particle layer 16A is then vibrated by the pressure and vibration applying unit 15-3 to increase the particle density. Thereafter, ink droplets are ejected from the inkjet recording head 20 onto the particle layer to form an image, wherein the ink is received by the ink receiving particles 16. The recording medium 8 and the intermediate transfer body 12 are then placed onto each other, pressed and heated by the transfer fixing unit 22, and the ink receiving particle layer is transferred and fixed onto the recording medium 8.

Fourth Embodiment

Figure 8:
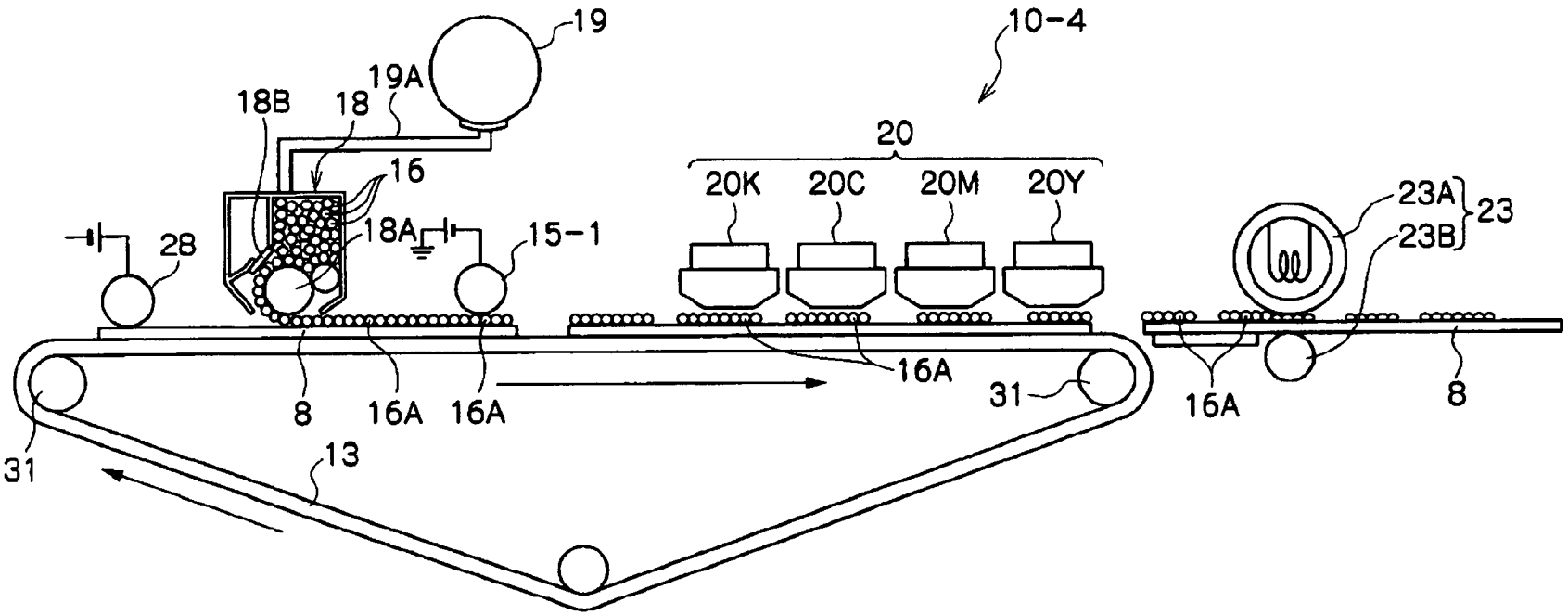
FIG. 8 is a schematic diagram showing a recording device according to a fourth exemplary embodiment.
Figure 9:
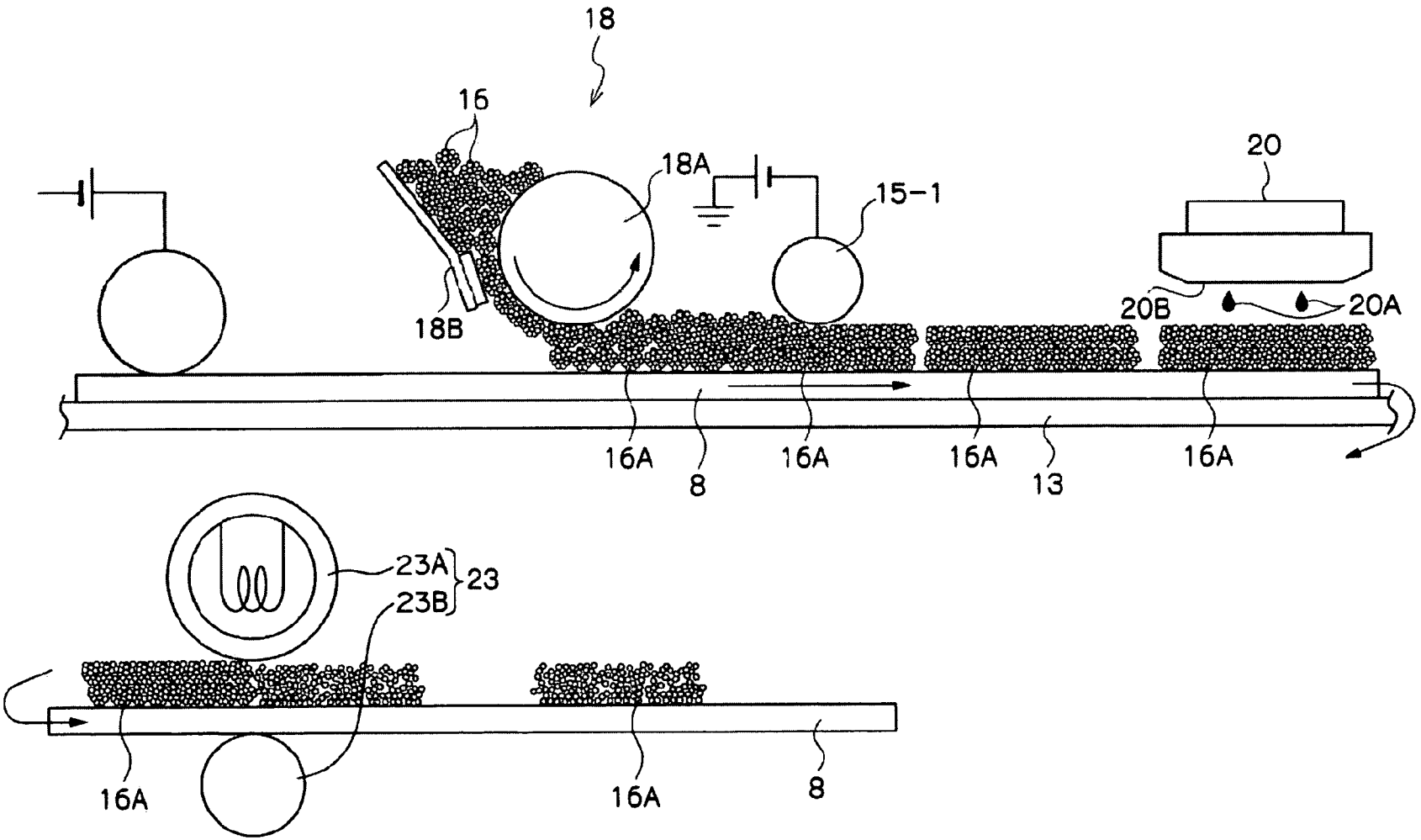
FIG. 9 is a schematic diagram showing a main part of the recording device according to the fourth exemplary embodiment.

FIG. 8 is a schematic diagram showing a recording device according to the fourth embodiment. FIG. 9 is a schematic diagram showing a main part of the recording device according to the fourth embodiment. In the fourth embodiment below, explanation will also be given according to the case where composite particles as described later are used as the ink receiving particles.

As shown in FIGS. 8 and 9, the recording device 10-4 according to the fourth embodiment includes a conveyor belt 13 in the form of an endless belt. The conveyor belt 13 is rotated to convey a recording medium 8 which has been delivered from a storage container (not shown) or the like.

First, the surface where an image is to be formed of the recording medium 8 being conveyed by the conveyor belt 13 is charged by the charger 28 to have a polarity opposite to that of the ink receiving particles 16.

The ink receiving particles 16 are supplied from the feed roll 18A of the particle feeder 18 onto the charged surface of the recording medium 8 and electrostatically adsorbed thereto, thereby forming an ink receiving particle layer 16A.

A pressure is applied from the pressure applying unit 15-1 to the ink receiving particle layer 16A formed on the recording medium 8. Ink droplets 20A of respective colors (see FIG. 10) are then ejected from inkjet recording heads 20K, 20C, 20M, and 20Y of black (K), cyan (C), magenta (M), and yellow (Y), respectively, onto the pressure-applied ink receiving particle layer 16A according to the image data, thereby forming an ink image (see FIG. 10(C)). Hereinafter, if necessary, the symbols Y, M, C, or K will be affixed to the end of the reference numeral in order to identify each color. If identification is not necessary, Y, M, C, or K will be omitted.

The ink receiving particle layer 16A with the ink image formed by the ejection of the ink droplets 20A is fixed onto the recording medium 8 by applying pressure and heat by a fixing unit 23.

An electrostatic recording head 100 (not shown) and the inkjet recording head 20 are line type recording heads, so-called FWA (Full Width Array) recording heads, with a width equal to or larger than that of the recording medium 8.

Each element and the image forming process will now be described in detail below.

The recording medium 8 is conveyed by the conveyor belt 13 in the form of an endless belt. In this embodiment, the recording medium 8 is conveyed while adsorbed onto the conveyor belt 13.

An example of the method of adsorbing the recording medium 8 onto the conveyor belt 13 includes a suction mechanism that utilizes pores (not shown) formed in the conveyor belt 13 to fix the medium by suctioning through the pores. Another example of the method of adsorbing the recording medium 8 onto the conveyor belt 13 may be a method of adsorbing by adhesive force or a method of electrostatically adsorbing the recording medium 8 onto the conveyor belt 13.

For example, a charger 28 for charging the surface of the recording medium 8 being conveyed on the conveyor belt 13 is placed upstream of the conveying direction and placed in contact with the surface of the recording medium 8. By the charger 28, the surface of the recording medium 8 is charged to have a polarity opposite to that of the ink receiving particles 6.

The recording medium 8 having the charged surface is then conveyed to the position under the particle feeder 18. The ink receiving particles 16 are supplied from the feed roll 18A of the particle feeder 18, and an ink receiving particle layer 16A is formed on the surface of the recording medium 8 by electrostatic force.

The recording medium 8 with the ink receiving particle layer 16A formed thereon is conveyed to the position under the pressure applying unit 15-1. Pressure is then applied from a pressing roll as the pressure applying unit 15-1, thereby increasing the density of the particles in the ink receiving particle layer 16A.

The recording medium 8 with the ink receiving particle layer 16A applied with pressure is conveyed to the position under the inkjet recording head 20.

Ink droplets 20A are ejected into the ink receiving particle layer 16A formed on the surface of the recording medium 8 according to the image data from the inkjet recording head 20, thereby forming an ink image. In this process, the ink is received by the ink receiving particles 16.

For high speed image printing, the inkjet recording head is preferably a line type inkjet recording head with a width equal to or larger than that of the recording medium as shown in this embodiment. However, images may also be sequentially formed using a scanning type inkjet recording head. The ink ejecting means of the inkjet recording head 20 may be any means capable of ejecting ink, such as a piezoelectric device driving type and a heating device driving type.

The recording medium 8 is then separated from the conveyor belt 13 and delivered to the fixing unit 23, at which pressure and heat are applied to the ink receiving particle layer 16A so that the ink receiving particle layer 16A is fixed onto the recording medium 8.

The fixing unit 23 includes a heating roll 23A containing a heat source and a pressing roll 23B placed opposite to the heating roll 23A. The heating roll 23A and the pressing roll 23B form a contact portion. For example, the heating roll 23A and the pressing roll 23B may each include an aluminum core coated with a silicone rubber, and further coated with a PFA tube. Such a structure is substantially the same as a fixing device (a fuser) for use in electro-photographic image-forming devices. Other than the heat fixing device for use in electro-photographic image-forming devices, a heater system, an oven system, an electromagnetic induction heating system, or the like may also be used.

When the recording medium 8 passes through the contact portion between the heating roll 23A and the pressing roll 23B, the ink receiving particle layer 16A is heated and pressed so that the ink receiving particle layer 16A is fixed onto the recording medium 8. The method using both heating and pressing may be replaced with a method using either one of heating or pressing. However, methods of performing heating and pressing at the same time are preferred.

The image formation is completed through the above processes, and the recording medium 8 is discharged out of the device.

Since the other elements are the same as those in the first embodiment, the descriptions thereof are omitted here. Also in this embodiment, the vibration applying unit or the pressure and vibration applying unit may be used in place of the pressure applying unit 15-1 (see the second and third embodiments).

In the recording device 10-4 according to this embodiment described above, the surface of the recording medium 8 is charged by the charger 28, and the ink receiving particles 16 are supplied from the particle feeder 18 to the charged recording medium 8 to form a particle layer, while the recording medium 8 is conveyed by the conveyor belt 13. The ink receiving particle layer 16A is then pressed by the pressure applying unit 15-1 to increase the particle density, and ink droplets are ejected from the inkjet recording head 20 onto the particle layer to form an image, wherein the ink is received by the ink receiving particle layer 16. Next, the recording medium 8 is separated from the conveyor belt 13, then pressed and heated by the fixing unit 23, so that the ink receiving particle layer is fixed onto the recording medium 8.

<Ink Receiving Particles>

Details of the ink receiving particles preferable used in the above embodiments will now be described. Explanations will be given without the symbols.

The ink receiving particles of the invention receive the ink component when the ink comes in contact with the ink receiving particles. The property "ink receiving" here means the ability to retain at least part of the ink components (at least a liquid component). The ink receiving particles of the invention include, for example, an organic resin having a polar group in the amount of from about 10 mol % to about 90 mol % with respect to the total amount of the monomers. Specifically, the ink receiving particles are, for example, the particles including the above-mentioned organic resin (hereinafter, referred to as "hydrophilic organic particles" and the particles including this hydrophilic organic particles are referred to as "matrix particles").

Here, the description "the ink receiving particles are hydrophilic" means that the particles include at least an organic resin in which the ratio of the polar monomer with respect to the total monomer component is in the range of about 10 mol % to about 90 mol %. These ink receiving particles has high viscosity relative to the hydrophobic particles.

The ink receiving particles may be in the form of the matrix particles each being composed of a single hydrophilic organic particle (primary particles), or may be in the form of the matrix particles in which plural hydrophilic organic particles aggregate to form composite particles.

When the matrix particles are in the form of a single hydrophilic organic particle (primary particles), at least a liquid component of the ink is absorbed by the hydrophilic organic particles at the time that the ink adheres to the ink receiving particles, when the ink receiving particles receive the ink.

The ink receiving particles that have received the ink are then transferred onto the recording medium, and recording is carried out.

On the other hand, when the matrix particles are the composite particles composed of aggregated hydrophilic organic particles, at least a liquid component of the ink is trapped in the voids among the particles composing the composite particles (at least the hydrophilic organic particles) (hereinafter, the voids are referred to as "trapping structure" sometimes) at the time that the ink adheres to the ink receiving particles, when the ink receiving particles receive the ink. At this time, the recording material in the ink components adheres to the surface of the ink receiving particles or is trapped in the trapping structure. The ink receiving particles that have received the ink are then transferred onto the recording medium, and recording is carried out.

The trapping of the ink liquid components by this trapping structure is a physical and/or chemical action of the voids among the particles (physical particle wall structure).

By employing the form of composite particles at least composed of aggregated hydrophilic organic particles for the matrix particles, the hydrophilic organic particles also serve to absorb and retain the ink liquid component, in addition to the trapping performed by the voids among the particles composing the composite particles (physical particle wall structure).

Further, the component in the hydrophilic organic particles composing the ink receiving particles also functions as a binder resin for a recording material contained in the ink or a coating resin, after transferring of the ink receiving particles. Moreover, when the ink receiving particles are in the form of composite particles, the recording material is trapped in the trapping structure thereof. It is particularly preferable that a transparent resin is used as the component in the hydrophilic organic particles composing the ink receiving particles.

In order to improve the fixability (wear resistance) of an ink using an insoluble component or a dispersed particulate substance such as a pigment as a recording material (e.g., a pigment ink), it is required to add a large amount of resin. However, when a large amount of a polymer is added in the ink (including the treating liquid thereof), reliability of the ink ejecting unit may be impaired (such as nozzle clogging). On the other hand, in the above constitution, the organic resin component composing the ink receiving particles could also serve as the above resin.

Here, the "voids among the particles composing the composite particles", i.e., the "trap structure" represents a physical particle wall structure at least capable of retaining a liquid component. The maximum opening size of the voids is preferably from about 0.1 μm to about 5 μm, more preferably from about 0.3 μm to about 1 μm. In particular, the maximum size of the voids is preferably large enough to trap a recording material, especially a pigment having a volume average particle diameter of about 100 nm or more, for example. Microscopic voids having the maximum opening size of less than about 50 nm may also exist. It is preferable that the voids or capillary tubes are in communication with each other inside the particles.

The size of the voids can be determined by reading a scanning electron microscope (SEM) image of the particle surface in an image analyzer; detecting the voids by binary coding process; then analyzing the size and distribution of the voids.

It is desirable that a recording material is also trapped together with a liquid component in the trapping structure. When the recording material, a pigment in particular, is trapped together with the ink liquid component in the trapping structure, the recording material can be retained and fixed within the ink receiving particles without being unevenly distributed. The ink liquid component here is mainly composed of an ink solvent or a dispersant (vehicle liquid).

The ink receiving particles of the invention will be described in more detail. The ink receiving particles may be in the form that the matrix particles are individually composed of a single hydrophilic organic particle (primary particle) or may be in the form that the matrix particles are the composite particles composed of at least aggregated hydrophilic organic particles. Particles other than the hydrophilic organic particles such as inorganic particles or porous particles may also constitute the composite particles. The matrix particles may be, of course, composed only of hydrophilic organic particles. For the particles other than hydrophobic organic particles to be attached onto the surface of the matrix particles, inorganic particles may also be used.

Figure 10:
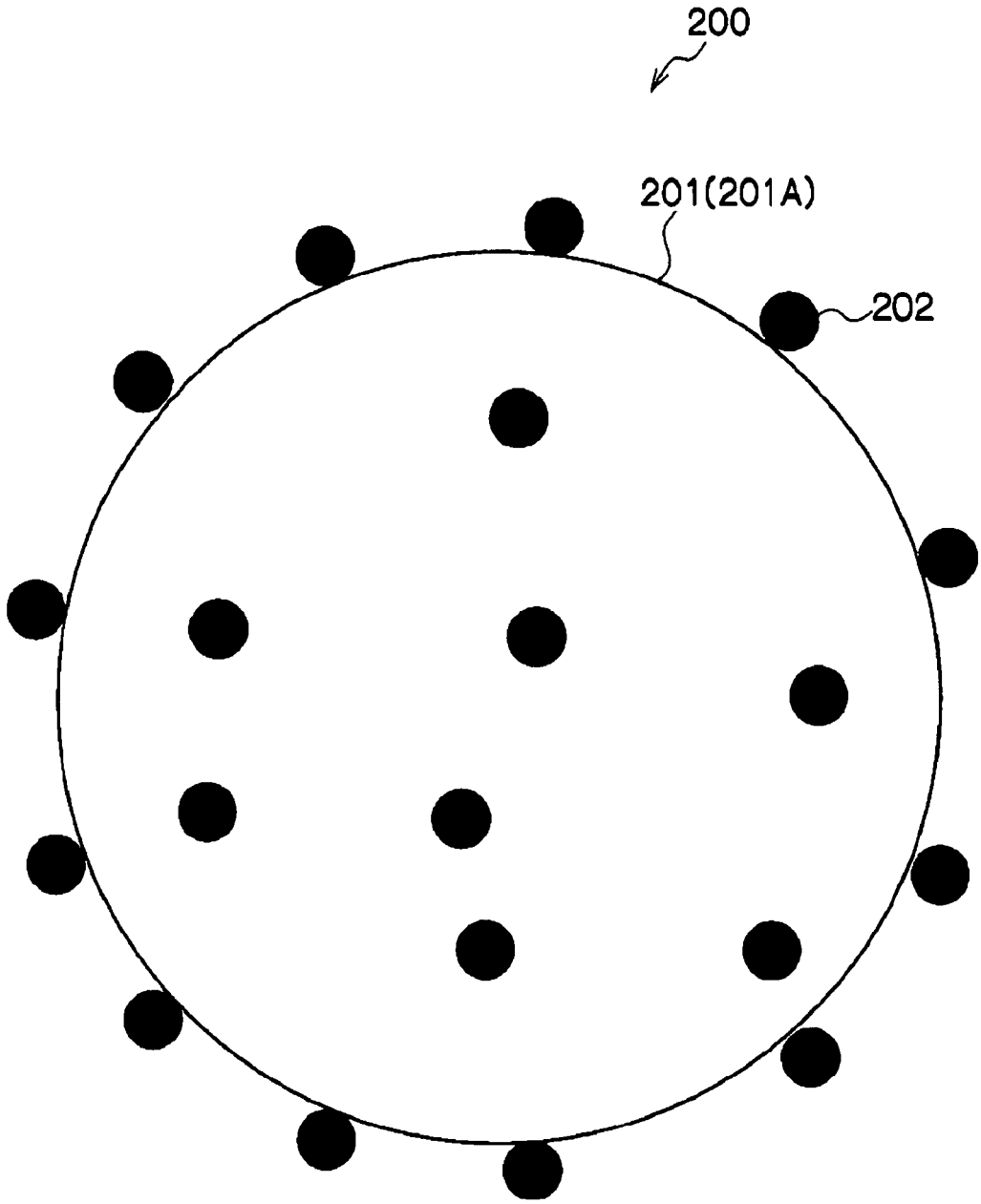
FIG. 10 is a schematic diagram showing an example of ink receiving particle according to the exemplary embodiments.
Figure 11:
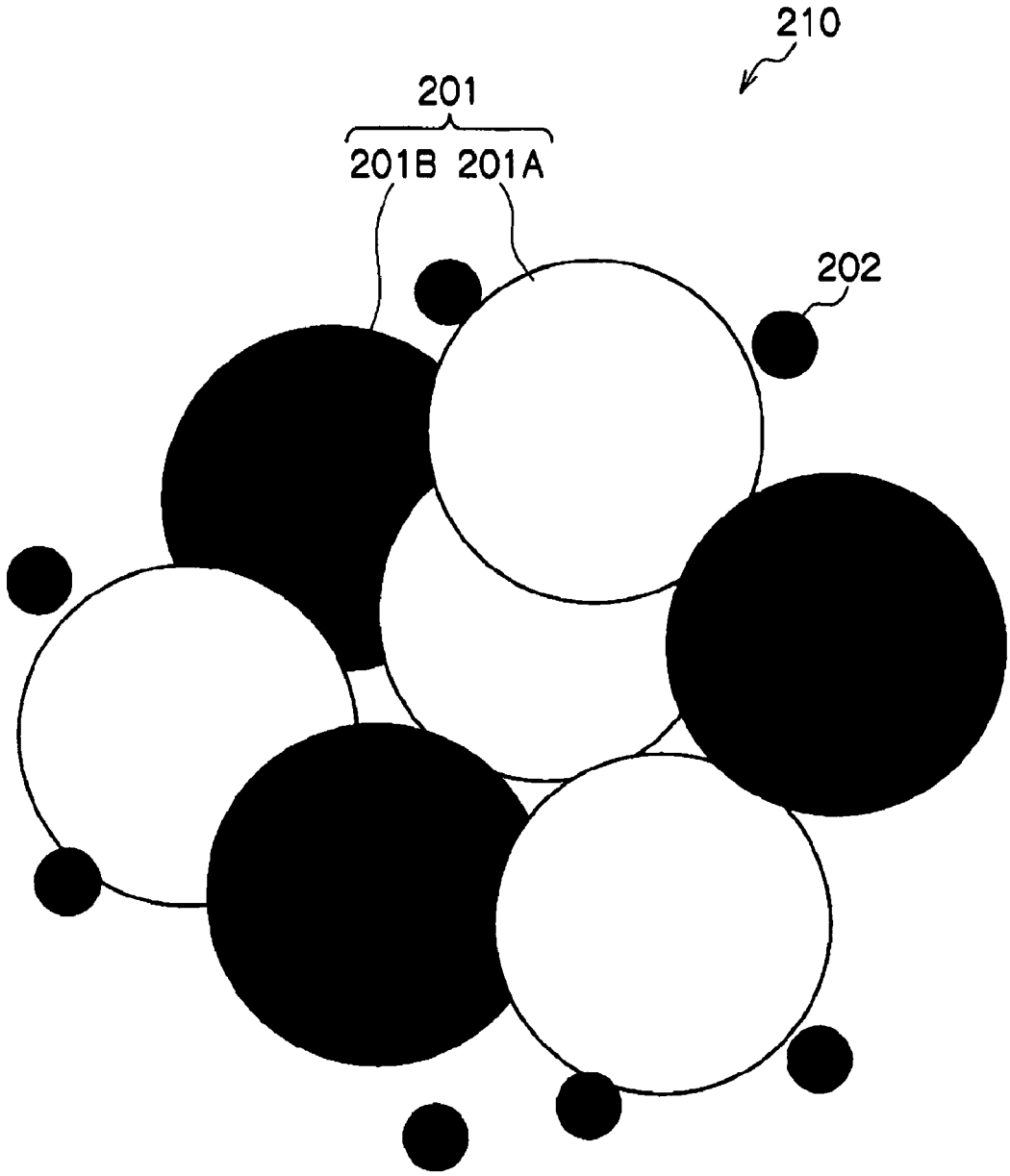
FIG. 11 is a schematic diagram showing another example of ink receiving particle according to the exemplary embodiments.

Specific structure of the ink receiving particle may be exemplified in FIG. 10, where an ink receiving particle 200 is composed of a single particle of hydrophilic organic resin particle 201A (primary particle), that constitutes matrix particle 201, and inorganic particles 202 attached onto the matrix particle 201. Another exemplary structure may be, as shown in FIG. 11, a structure in which an ink receiving particle 210 is composed of a matrix particle 201 in the form of a composite of hydrophilic organic particles 201A and inorganic particles 201B, and inorganic particles 202 attached onto the matrix particle 201. In the case of the matrix particles in the form of a composite, a void structure can be created by the voids among the component particles.

The ratio by weight of the hydrophilic organic particles and other particles (hydrophilic organic particles:other particles) may be, for example, in the range of from about 5:1 to about 1:10, in the case where the matrix particle is in the form of a composite and the other particles are inorganic particles.

The volume average particle size of the matrix particles is preferably from about 0.1 μm to about 50 μm, more preferably from about 0.5 μm to about 25 μm, and still more preferably from about 1 μm to about 10 μm.

The BET specific surface area ($N_2$) of the matrix particle in the form of a composite is, for example, in the range of from about 1 $m^2/g$ to about 750 $m^2/g$.

The composite particles composing the matrix particles may be obtained by granulating the particles in a semi-sintered state. Being in a semi-sintered state means that the shape of the particles remains to a certain degree and the voids among the particles are maintained. The composite particles may be partly dissociated when the ink liquid component is trapped in the trapping structure, i.e., the composite particles may be decomposed to scatter the component particles.

The hydrophilic organic particles will now be described. The hydrophilic organic particles contain, for example, a polar monomer in the ratio of from about 10 mol % to about 90 mol % with respect to the total component of the monomer, preferably from about 15 mol % to about 85 mol %, and further preferably contain an organic resin of from about 30 mol % to about 80 mol %. Specifically, the hydrophilic organic particles preferably contain an organic resin composed of a polar monomer in the ratio of the above range.

Here, the polar monomer represents a monomer containing an ethylene oxide group, carboxylic acid group, sulfonic acid group, substituted or non-substituted amino group, hydroxyl group, ammonium group or a salt thereof. For example, in the case of imparting a positive charge, the monomer preferably has a salt forming structure of (substituted) amino group, ammonium group, (substituted) pyridine group or an amine salt thereof, quaternary ammonium salt and the like. In the case of imparting a negative charge, the monomer is preferably an organic acid (salt) structure of carboxylic acid (salt), sulfonic acid (salt), and the like.

The ratio of the polar monomer can be determined by identifying the structure of the organic component according to analytical methods such as mass spectrometry, NMR or IR; measuring the acid value and base value of the organic component in accordance with JIS K0070 or JIS K2501; and then calculating the ratio of the polar monomer from the structure of the organic component and the acid/base values thereof (hereinafter, the same shall apply).

The hydrophilic organic particles are, for example, composed of a liquid absorbing resin. The ink liquid component (such as water or an aqueous solvent) absorbed in the resin serving as a plasticizer may soften the resin (polymer) and contribute to fixability.

The liquid absorbing resin is preferably a weak liquid absorbing resin. The weak liquid absorbing resin represents a lyophilic resin capable of absorbing a liquid in the range of from several percents (approximately 5%) to several hundreds of percents (approximately 500%), preferably from about 5% to about 150%, relative to a resin by weight, when water is absorbed as a liquid.

The liquid absorbing resin may be composed of either a homopolymer of a hydrophilic monomer or a copolymer of a hydrophilic monomer and a hydrophobic monomer, but preferably a copolymer in order to obtain a weak liquid absorbing resin. The resin may also be a graft copolymer or a block copolymer obtained by copolymerizing a starting unit having a structure of polymer, oligomer or the like with other units.

Examples of the hydrophilic monomers include monomers having a group such as —OH, -EO unit (ethylene oxide group), —COOM (M is a hydrogen, an alkali metal such as Na, Li, K, ammonia, organic amines, or the like), —$SO_3M$ (M is a hydrogen, alkali metal such as Na, Li, K, ammonia, organic amines, or the like.), —$NR_3$ (R is H, alkyl, phenyl or the like), and —$NR_4X$ (R is H, alkyl, phenyl or the like, and X is a halogen, a sulfate radical, acidic anions such as a carboxylic acid, $BF_4$, or the like). Specific examples of the hydrophilic monomer include 2-hydroxy ethyl methacrylate, 2-hydroxy ethyl acrylate, acrylamide, acrylic acid, methacrylic acid, unsaturated carboxylic acid, crotonic acid, and maleic acid. Examples of a hydrophilic unit or monomer include cellulose derivatives such as cellulose, ethyl cellulose, carboxy methyl cellulose; starch derivatives, derivatives of monosaccharides and polysaccharides, vinyl sulfonic acid, styrene sulfonic acid, polymerizable carboxylates such as acrylic acid, methacrylic acid and (anhydrous) maleic acid, and (partially) neutralized salts thereof; vinyl alcohols; derivatives such as vinyl pyrrolidone, vinyl pyridine, amino (meth)acrylate or dimethyl amino(meth)acrylate, or onium salts thereof; amides such as acrylamide or isopropyl acrylamide; vinyl compounds containing a polyethylene oxide chain; vinyl compounds containing a hydroxyl group; polyesters composed of a polyfunctional carboxylic acid and a polyhydric alcohol, especially branched polyesters having three or more acids and plural carboxylic acids or hydroxyl groups at the end portion such as trimellitic acid, or polyesters having a polyethylene glycol structure, and the like.

Examples of the hydrophobic monomers include monomers a having hydrophobic group, and specific examples thereof include olefins (etyrene, butadiene and the like), styrene, alpha-methyl styrene, alpha-ethyl styrene, methyl methacrylate, ethyl methacrylate, butyl methacrylate, acrylonitrile, vinyl acetate, methyl acrylate, ethyl acrylate, butyl acrylate, lauryl methacrylate, and the like. Examples of the hydrophobic units or monomers include styrene derivatives such as styrene, alpha-methyl styrene, vinyl toluene; vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate, dialkyl maleate, and derivatives thereof.

Specific examples of the liquid absorbing resins composed of copolymers of the above hydrophilic monomers and the hydrophobic monomers include (meth)acrylates, copolymers of styrene/(meth)acrylic acid/(anhydrous) maleic acid, olefin polymers of ethylene/propylene or the like (or modifications thereof or products thereof into which a carboxylic acid unit is introduced by copolymerization), branched polyesters having an enhanced acid value by a trimellitic acid or the like, polyamides, and the like.

The liquid absorbing resin preferably includes a structure of neutralized salt (for example, a carboxylic acid). The neutralized salt structure such as a carboxylic acid forms an ionomer when the resin absorbs an ink containing a cation (for example, a monovalent metal cation such as Na and Li), by the interaction with the cation.

The liquid absorbing resin preferably contains a substituted or non-substituted amino group, or a substituted or non-substituted pyridine group. Such a group can provide a bactericidal effect or cause an interaction with a recording material having an anion group (for example, a pigment or a dye), thereby improving image quality or fixing properties.

In the liquid absorbing resin, the molar ratio of the hydrophilic unit (hydrophilic monomer) and the hydrophobic unit (hydrophobic monomer), i.e., hydrophilic monomer:hydrophobic monomer, is preferably from about 5:95 to about 70:30.

The liquid absorbing resin may be ion-crosslinked by an ion supplied from the ink. Specifically, a unit having a carboxylic acid such as copolymers containing a carboxylic acid such as (meth)acrylic acid or maleic acid or a (branched) polyesters having a carboxylic acid can be included in the liquid absorbing resin. It is estimated that the ion crosslinking or acid-base interaction occurs between the carboxylic acid in the resin and the cation supplied from the ink such as an alkali metal cation, alkali earth metal cation, or an organic amine/onium cation.

Common characteristics of the liquid absorbing resins and the non-liquid absorbing resins that constitute the hydrophobic organic particles (hereinafter, collectively referred to as organic resins) will be described.

The liquid absorbing resin may have a straight chain structure, but preferably has a branched structure. Further, the liquid absorbing resin is preferably non-crosslinked or low crosslinked. The liquid absorbing resin may be a random copolymer or a block copolymer having a straight chain structure, but is more preferably a polymer having a branched structure (including a random copolymer, block copolymer and graft copolymer of branched structure). For example, in the case of polyesters that can be synthesized by polycondensation, the number of the end groups can be increased in a branched structure. Such branched structure can be obtained by the common methods, e.g., adding of a so-called crosslinking agent such as divinyl benzene or di(meth)acrylates at the time of synthesizing (for example, addition of less than about 1%) or adding of a large amount of an initiator together with the crosslinking agent.

The liquid absorbing resin may further include a charge controlling agent for electrophography of low molecular weight, such as quaternary ammonium salts, organic borates, salt-forming compounds of a salicylic acid derivative. In order to control the conductivity, it is effective to add an inorganic material having conductivity (hereinafter, the term "having conductivity" is defined, for example, as "having a volume resistivity of about $10^7\Omega\cdot$cm of less, unless otherwise specified), or having semiconductivity (hereinafter, the term "having semiconductivity" is defined, for example, as "having a volume resistivity of from about $10^7\Omega\cdot$cm to about $10^{13}\Omega\cdot$cm, unless otherwise specified).

The organic resin is preferably an amorphous resin having a glass transition temperature (Tg) of, for example, from about 40° C. to about 90° C. The glass transition temperature (and the melting point) is determined from the major maximum peak measured in accordance with ASTMD 3418-8. The major maximum peak can be measured by using DSC-7 (manufactured by Perkin Elmer Japan Co., Ltd). In this apparatus, temperature of detection unit is corrected according to the melting points of indium and zinc, and the calorimetric value is corrected according to the heating of fusion of indium. Measurement for a sample is carried out at an elevated rate of temperature of 10° C./min using an aluminum pan while an empty pan is set for a control.

The weight-average molecular weight of the liquid absorbing resin is, for example, from about 3,000 to about 300,000. The weight-average molecular weight is measured under the following conditions: for example, HLC-8120GPC, SC-8020 (manufactured by TOSOH CORPORATION) is used as a GPC apparatus, two pieces of TSK gel, SuperHM-H (manufactured by TOSOH CORPORATION, 6.0 mm ID×15 cm) are used as columns, and THF (tetrahydrofuran) is used as an eluent. The experiment can be carried out under the following conditions: the sample density of about 0.5%, flow rate of about 0.6 m/min, sample injection amount of about 10 μl, measuring temperature of about 40° C., and using an IR detector. A calibration curve is prepared from ten of polystyrene standard sample TSK standards manufactured by TOSOH CORPORATION, A-500, F-1, F-10, F-80, F-380, A-2500, F-4, F-40, F-128 and F-700.

The acid value of the liquid absorving resin may be, for example, from about 50 mg KOH to about 777 mg KOH, as expressed by a carboxylic acid group (—COOH). The acid value as expressed by a carboxylic acid group (—COOH) can be measured as follows.

The acid value can be measured by a neutralization titration method in accordance with JIS K 0070 (the disclosure of which is incorporated herein by reference): a proper amount of the sample is mixed with 100 ml of a solvent (diethyl ether/ethanol mixture) with the addition of several droplets of an indicator (phenolphthalein solution). The resulting mixture is then shaken in a water bath until the sample is completely dissolved. The solution is titrated with 0.1 mol/L of a potassium hydroxide ethanol solution, and the point at which a scarlet color of the indicator continues to exhibit for 30 seconds is determined as the end point.

The acid value is then calculated by the following equation:

$$A=(B\times f\times 5.611)/S$$

In the above equation, A represents the acid value; S is the sample amount (g); B is the amount (ml) of 0.1 mol/L of potassium hydroxide ethanol solution used in titration; and f is a factor of 0.1 mol/L of potassium hydroxide ethanol solution.

The above-described liquid absorbing resins in any form contain the ratio of the polar monomer within the above-described range.

The particle diameter of the hydrophilic particles when the primary particle thereof is a matrix particle is from about 0.1 μm to about 50 μm, preferably from about 0.5 μm to about 25 μm, and more preferably from about 1 μm to about 10 μm, in terms of average particle diameter. On the other hand, when the hydrophilic particle is a component of a composite particle, the particle diameter is from about 10 nm to about 30 μm, preferably from about 50 nm to about 10 μm, and more preferably from about 0.1 μm to about 5 μm, in terms of average particle diameter.

The ratio of the hydrophilic particles with respect to the total ink receiving particles is, for example, about 75% by weight or more, preferably about 85% by weight or more, and more preferably from about 90% by weight to about 99% by weight.

Details of the inorganic particles that forms the composite particles together with the hydrophilic particles or the inorganic particles attached to the matrix particles will now be explained. The inorganic particles may be porous or may not be porous. Examples of the inorganic particles include colorless, pale color, or white particles of, for example, colloidal silica, alumina, calcium carbonate, zinc oxide, titanium oxide, tin oxide and the like. These inorganic particles may be subjected to a surface treatment (partial hydrophobic treatment, introduction of a specific functional group, etc.). In the case of silica, for example, a hydroxyl group in silica is treated with a silylating agent such as trimethyl chlorosilane or t-butyl dimethyl chlorosilane to introduce an alkyl group. Then, dehydrochlorination takes place by silylating agent, and reaction progresses. In this process, the reaction can be promoted by adding an amine to convert the hydrochloric acid into hydrochloride. The reaction can be controlled by regulating the amount of a silane coupling agent having an alkyl group or phenyl group as a hydrophobic group, or a titanate- or zirconate-based coupling agent, or the conditions for the treatment. The surface treatment can also be carried out by using aliphatic alcohols, higher fatty acids or derivatives thereof. Further, the surface treatment can also be carried out by using a coupling agent having a cationic functional group such as a silane coupling agent having a (substituted) amino group or a quaternary ammonium salt structure, a coupling agent having a fluorine functional group such as fluorosilane, and other coupling agents having an anionic functional group such as a carboxylic acid. The inorganic particles may be included inside of the hydrophilic organic particles, i.e., internally added.

The particle diameters of the inorganic particles that constitute the composite particle are, for example, from about 10 nm to about 30 μm, preferably from about 50 nm to about 10 μm and more preferably from about 0.1 μm to about 5 μm, in terms of particle average diameter. On the other hand, the particle diameter of the inorganic particles to be attached to the matrix particle is, for example, from about 10 nm to about 1 μm, preferably from about 10 nm to about 0.1 μm, and more preferably from about 10 nm to about 0.05 μm, in terms of particle average diameter.

Next, details of the other additives for the ink receiving particles will be described. The ink receiving particles preferably contain a component that aggregates or thickens the ink component.

The component having the above functions may be contained in the form of a functional group in a resin constituting the above liquid absorbing resin, or in the form of a compound. Examples of such functional groups include a carboxylic acid, polyhydric metal cations, polyamines and the like.

Preferred examples of the above compound include aggregating agents such as inorganic electrolytes, organic acids, inorganic acids, organic amines and the like.

Examples of the inorganic electrolytes include a salt of an alkali metal ion such as a lithium ion, a sodium ion, a potassium ion, or a polyvalent metal ion such as an aluminum ion, a barium ion, a calcium ion, a copper ion, an iron ion, a magnesium ion, a manganese ion, a nickel ion, a tin ion, a titanium ion and a zinc ion; and an inorganic acid such as hydrochloric acid, hydrobromic acid, hydriodic acid, sulfuric acid, nitric acid, phosphoric acid and thiocyanic acid, an organic carboxylic acid such as acetic acid, oxalic acid, lactic acid, fumaric acid, citric acid, salicylic acid and benzoic acid, or an organic sulfonic acid.

Specific examples of the above inorganic electrolytes include an alkali metal salt such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate; and a polyvalent metal salt such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, ion iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Specific examples of the organic acids include arginine acid, citric acid, glycine, glutamic acid, succinic acid, tartaric acid, cysteine, oxalic acid, fumaric acid, phthalic acid, maleic acid, malonic acid, lycine, malic acid, and compounds represented by Formula (1) and derivatives thereof.

Formula (1)

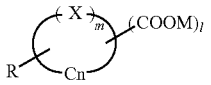

In the Formula (1), X represents O, CO, NH, $NR_1$, S or $SO_2$; R represents an alkyl group and is preferably $CH_3$, $C_2H_5$ and $C_2H_4OH$, wherein R may be included in the Formula or may not be included; X is preferably CO, NH, NR or O, and more preferably CO, NH or O; M represents a hydrogen atom, an alkali metal or an amine and is preferably H, Li, Na, K, monoethanol amine, diethanol amine, triethanol amine or the like, more preferably H, Na or K, and further preferably a hydrogen atom; n represents an integer of from 3 to 7 and is preferably an integer with which the heterocyclic ring is a six-membered or five-membered ring, and more preferably an integer with which the heterocyclic ring is a five-membered ring; and m represents 1 or 2. The compound represented by the Formula (1) may be a saturated ring or an unsaturated ring as long as the compound is in the form of a heterocyclic ring. 1 represents an integer of from 1 to 5.

Examples of the compounds represented by the Formula (1) include compounds having a structure of furan, pyrrole, pyrroline, pyrrolidone, pyrone, pyrrole, thiophene, indole, pyridine or quinoline, and further including a carboxyl group as a functional group. Specific examples of the compounds include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolide-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrole-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferable examples of the organic acids include citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives or salts thereof. The organic acid is more preferably pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or a derivative or salt thereof. The organic acid is further preferably pyrrolidone carboxylic acid, pyrone carboxylic acid, furan carboxylic acid, coumaric acid, or a derivative or salt thereof.

An organic amine compound may be any of a primary amine, secondary amine, tertiary amine, quaternary amine and a salt thereof. Specific examples of the organic amine compounds include a tetraalkyl ammonium, alkylamine, benzalconium, alkylpyridium, imidazolium, polyamine and a derivative or salt thereof, such as amyl amine, butyl amine, propanol amine, propyl amine, ethanol amine, ethyl ethanol amine, 2-ethyl hexyl amine, ethyl methyl amine, ethyl benzyl amine, ethylene diamine, octyl amine, oleyl amine, cyclooctyl amine, cyclobutyl amine, cyclopropyl amine, cyclohexyl amine, diisopropanol amine, diethanol amine, diethyl amine, di-2-ethylhexyl amine, diethylene triamine, diphenyl amine, dibutyl amine, dipropyl amine, dihexyl amine, dipentyl amine, 3-(dimethyl amino) propyl amine, dimethyl ethyl amine, dimethyl ethylene diamine, dimethyl octyl amine, 1,3-dimethyl butyl amine, dimethyl-1,3-propane diamine, dimethyl hexyl amine, amino butanol, amino propanol, amino propane diol, N-acetyl amino ethanol, 2-(2-amino ethyl amino)-ethanol, 2-amino-2-ethyl-1,3-propane diol, 2-(2-amino ethoxy) ethanol, 2-(3,4-dimethoxy phenyl) ethyl amine, cetyl amine, triisopropanol amine, triisopentyl amine, triethanol amine, trioctyl amine, trityl amine, bis(2-aminoethyl) 1,3-propane diamine, bis(3-aminopropyl) ethylene diamine, bis(3-aminopropyl) 1,3-propane diamine, bis(3-amino propyl) methyl amine, bis (2-ethyl hexyl) amine, bis (trimethyl silyl) amine, butyl amine, butyl isopropyl amine, propane diamine, propyl diamine, hexyl amine, pentyl amine, 2-methyl-cyclohexyl amine, methyl-propyl amine, methyl benzyl amine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxy ethyl stearyl amine, 2-heptadecenyl-hydroxyethyl imidazoline, lauryl dimethyl benzyl ammonium chloride, cetylpyridinium chloride, stearamid methylpyridium chloride, a diaryl dimethyl ammonium chloride polymer, a diaryl amine polymer, and a monoaryl amine polymer.

Among these organic amine compounds, triethanol amine, triisopropanol amine, 2-amino-2-ethyl-1,3-propanediol, ethanol amine, propane diamine, and propyl amine are more preferably used.

Among the above aggregating agents, polyvalent metal salts such as $Ca(NO_3)$, $Mg(NO_3)$, $Al(OH_3)$, a polyaluminum chloride and the like, are preferably used.

The aggregating agent may be used alone or in combination of two or more kinds thereof. The content of the aggregating agent is preferably from about 0.01% by weight to about 30% by weight, more preferably from about 0.1% by weight to about 15% by weight, and further preferably from about 1% by weight to about 15% by weight.

The ink receiving particles of the invention preferably contain a releasing agent. The releasing agent may be contained in the liquid absorbing resin, or may be included in the form of releasing agent particles by compounding with particles of liquid absorbing resin.

Examples of the releasing agents include low molecular polyolefins such as polyethylene, polypropylene and polybutene; silicones having a softening point by heating; fatty acid amides such as oleic amide, erucic amide, ricinoleic amide and stearic amide; vegetable waxes such as carnauba wax, rice wax, candelilla wax, Japan wax and jojoba oil; animal waxes such as beeswax; mineral or petroleum waxes such as montan wax, ozokerite, ceresin, paraffin wax, microcrystalline wax and Fischer-Tropsch wax; and modifications thereof. Among them, crystalline compounds are preferably used.

Hereinafter, details of the ink used in the above exemplary embodiment will be described. In the embodiment, a water-based ink is used. The water-based ink (hereinafter, simply referred to as an ink) may contain an ink solvent (for example, water or a water soluble organic solvent), in addition to a recording material. As required, other additives may be also contained in the ink.

Details of the recording material will now be explained. A colorant is mainly used as the recording material, which may be either a dye or a pigment, but is preferably a pigment. Either an organic pigment or an inorganic pigment can be used as the pigment. Examples of the black pigments include carbon black pigments such as furnace black, lamp black, acetylene black, and channel black. In addition to black and three primary colors of cyan, magenta and yellow, other pigments of specific colors such as red, green blue, brown or white, metal glossy pigments of gold, silver or the like, body pigments of colorless or pale color, plastic pigments, or the like. A pigment newly synthesized for the invention may also be used.

Further, particles composed of a core of silica, alumina, polymer bead or the like on which a dye or a pigment is fixed, an insoluble lake compound of a dye, a colored emulsion, a colored latex or the like can also be used as a pigment.

Specific examples of the black pigments used in the present invention include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Carbon Company); REGAL 400R, REGAL 330R, REGAL 660R, MOGUL L, Black Pearls L, MONARCH 700, MONARCH 800, MONARCH 880, MONARCH 900, MONARCH 1000, MONARCH 1100, MONARCH 1300 and MONARCH 1400 (manufactured by Cabot Corporation); Color Black FW1, Color Black FW2, Color Black FW2V, Color Black 18, Color Black FW200, Color Black S150, Color Black S160, Color Black S170, PRINTEX 35, PRINTEX U, PRINTEX V, PRINTEX 140U, PRINTEX 140V, Special Black 6, Special Black 5, Special Black 4A and Special Black 4 (manufactured by Degussa Co.); and No. 25, No. 33, No. 40, No. 47, No. 52, No. 900, No. 2300, MCF-88, MA 600, MA 7, MA 8 and MA 100 (manufactured by Mitsubishi Chemical Co., Ltd.). However, the pigments are not restricted thereto.

Specific examples of the cyan color pigments include C.I. Pigment Blue-1, -2, -3, -15, -15:1, -15:2, -15:3, -15:4, -16, -22 and -60, but not restricted thereto.

Specific examples of the magenta color pigments include C.I. Pigment Red-5, -7, -12, -48, -48:1, -57, -112, -122, -123, -146, -168, -177, -184, -202, and C.I. Pigment Violet-19, but not restricted thereto.

Specific examples of the yellow color pigments include C.I. Pigment Yellow-1, -2, -3, -12, -13, -14, -16, -17, -73, -74, -75, -83, -93, -95, -97, -98, -114, 128, -129, -138, -151, -154 and -180, but not restricted thereto.

Here, in the case where a pigment is used as the colorant, it is preferable to use a pigment dispersing agent in combination. Examples of usable pigment dispersing agents include a polymer dispersing agent, an anionic surfactant, a cationic surfactant, an amphoteric surfactant and a nonionic surfactant.

As the polymer dispersing agent, a polymer having both of a hydrophilic structure part and a hydrophobic structure part are preferably used. As the polymer having a hydrophilic structure part and a hydrophobic structure part, a condensation-based polymer and an addition polymer can be used. Examples of the condensation-based polymers include known polyester based dispersing agents. Examples of the addition polymers include addition polymers of monomers having an α,β-ethylenically unsaturated group. By copolymerizing a monomer having an α,β-ethylenically unsaturated group having a hydrophilic group and a monomer having an α,β-ethylenically unsaturated group having a hydrophobic group, a desired polymer dispersing agent can be obtained. Further, a homopolymer of monomers having an α,β-ethylenically unsaturated group having a hydrophilic group can also be used.

Examples of the monomers having an α,β-ethylenically unsaturated group having a hydrophilic group include monomers having a carboxyl group, a sulfonic acid group, a hydroxyl group, a phosphoric acid group or the like; specifically, acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxy ethyl phosphate, bis(methacryloxy ethyl) phosphate, methacryloxy ethyl phenyl acid phosphate, ethylene glycol dimethacrylate, diethylene glycol dimethacrylate and the like.

Examples of the monomer having an α,β-ethylenically unsaturated group having a hydrophobic group include styrene derivatives such as styrene, α-methylstyrene and vinyl toluene, vinyl cyclohexane, vinyl naphthalene, vinyl naphthalene derivatives, alkyl acrylate, alkyl methacrylate, phenyl methacrylate, cycloalkyl methacrylate, alkyl crotonate, dialkyl itaconate, dialkyl maleate and the like.

Preferable examples of the copolymers used as a polymer dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. A monomer having a polyoxyethylene group or a hydroxyl group may also be copolymerized with the above polymers.

As the above-mentioned polymer dispersing agent have, for example, a weight average molecular weight of from about 2,000 to about 50,000.

These pigment dispersing agents may be used alone or in combination of two or more kinds. Although the addition amount of the pigment dispersing agent varies largely dependent on the types of the pigments, the addition amount thereof is generally in the range of from about 0.1% by weight to about 100% by weight with respect to the amount of the pigment.

A pigment capable of self-dispersing in water can also be used as a colorant. The pigment capable of self-dispersing in water used in the present invention refers to the pigment that has a large number of water-solubilizing groups on the surface of the pigment and is capable of dispersing in water without the presence of a polymer dispersant. The pigment capable of self-dispersing in water is practically obtained by subjecting a common so-called pigment to surface modification treatments such as an acid or a base treatment, a coupling agent treatment, a polymer graft treatment, a plasma treatment or a redox treatment.

In addition to the above surface-modified pigments, commercially available pigments such as CAB-O-JET-200, CAB-O-JET-300, IJX-157, IJX-253, IJX-266, IJX-273, IJX-444, IJX-55, and CABOT 260 (manufactured by Cabot Corporation), and MICROJET BLACK CW-1 and CW-2 (manufactured by Orient Chemical Industries, Ltd.) may also be used as a pigment capable of self-dispersing in water.

The above self-dispersing pigments are preferably a pigment having at least a functional group of sulfonic acid, a sulfonate, a carboxylic acid, or a carboxylate on the surface thereof, and more preferably a pigment having a functional group of at least a carboxylic acid, or a carboxylate on the surface thereof.

A pigment coated with a resin may also be used as the colorant. Such a pigment is called as a microcapsule pigment, which include commercially available microcapsule pigments manufactured by Dainippon Ink & Chemicals, Inc. and Toyo Ink MFG Co., Ltd. as well as the microcapsule pigments prepared for use in the invention.

A resin dispersing-type pigment composed of the above pigment onto which a polymer substance is adsorbed or chemically bonded can also be used.

Other examples of the recording materials include dyes such as a hydrophilic anionic dye, direct dye, cationic dye, reactive dye, high molecular dye and an oil-soluble dye, wax powder, resin powder or emulsions colored by a dye, fluorescent dye or fluorescent pigment, infrared absorber, ultraviolet absorber, magnetic materials such as ferromagnetic materials represented by ferrite, magnetite and others, semiconductors and photo catalysts represented by titanium oxide, zinc oxide and others, and other organic and inorganic particles of an electronic material.

The content (density) of the recording material is, for example, from about 5% by weight to about 30% by weight with respect to the amount of the ink.

The volume average particle size of the colorant is, for example, from about 10 nm to about 1,000 nm.

The volume average particle size of the colorant refers to the particle size of the colorant itself, or when an additive such as a dispersing agent is attached onto the colorant, the particle size together with the attached additive. In the invention, as the device for measurement of the volume average particle size, MICROTRUCK UPA particle size analysis meter 9340 (produced by Leeds & Northrup Corp.) is used. The measurement is carried out according to the predetermined method with 4 ml of an ink put into a measuring cell. As the parameters to input for the measurement, the viscosity of the ink for an inkjet is regarded as the viscosity, and the density of the colorant is regarded as the density of the dispersion particles.

Next, a water-soluble organic solvent will be mentioned. As a water-soluble organic solvent, polyhydric alcohols, polyhydric alcohol derivatives, nitrogen-containing solvents, alcohols, sulfur-containing solvents and the like may be used.

Specific examples of the polyhydric alcohols include sugar alcohols such as ethylene glycol, diethylene glycol, propylene glycol, butylene glycol, triethylene glycol, 1,5-pentane diol, 1,2,6-hexane triol, glycerin, trimethylolpropane and xylitol; and saccharides such as xylose, glucose and galactose.

Specific examples of the polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and the ethylene oxide adduct of diglycerin.

Specific examples of the nitrogen-containing solvents include pyrrolidone, N-methyl-2-pyrrolidone, cyclohexyl pyrrolidone, and triethanol amine. Specific examples of the alcohols include ethanol, isopropyl alcohol, butyl alcohol and benzyl alcohol. Specific examples of the sulfur-containing solvents include thiodiethanol, thiodiglycerol, sulfolane, and dimethyl sulfoxide.

Propylene carbonates, ethylene carbonates, or the like may also be used as the water-soluble organic solvent.

The water-soluble organic solvent may be used one or more kinds thereof. The content of the water-soluble organic solvent to be used is, for example, from about 1% by weight to about 70% by weight.

Next, water will be explained. As the water, ion exchange water, ultra pure water, distilled water or ultrafiltrated water are preferably used in order to prevent introduction of impurities.

Next, other additives will be explained. A surfactant may be added to the ink.

As the surfactants, various kinds of anionic surfactants, nonionic surfactants, cationic surfactants, amphoteric surfactants and the like may be used, and the anionic surfactants and the nonionic surfactants are preferably used.

Specific examples of the anionic surfactants include an alkylbenzenesulfonate, alkylphenylsulfonate, alkylnaphthalenesulfonate, higher fatty acid salt, sulfuric acid ester salt of higher fatty acid ester, sulfonic acid salt of higher fatty acid ester, sulfuric acid ester salt and sulfonic acid salt of higher alcohol ether, higher alkylsulfosuccinate, polyoxyethylenealkyl ethercarboxylate, polyoxyethylenealkyl ethersulfate, alkylphosphate and polyoxyethylenealkyl etherphosphate, and dodecylbenzenesulfonate, isopropylnaphthalenesulfonate, monobutylphenylphenol monosulfonate, monobutylbiphenylsulfonate, monobutylbiphenylsulfonate and dibutylphenylphenoldisulfonate are preferably used.

Specific examples of the nonionic surfactants include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene sorbitol fatty acid ester, glycerine fatty acid ester, polyoxyethyleneglycerine fatty acid ester, polyglycerine fatty acid ester, sucrose fatty acid ester, polyoxyethylenealkylamine, polyoxyethylene fatty acid amide, alkylalkanol amide, polyethyleneglycol polypropyleneglycol block copolymer, acetylene glycol and polyoxyethylene adduct of acetylene glycol, and polyoxyethylene adducts such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethyleneglycol polypropyleneglycol block copolymer, acetylene glycol and polyoxyethylene adduct of acetylene glycol are preferably used.

In addition, silicone surfactants such as polysiloxaneoxyethylene adducts, fluorine-based surfactants such as perfluoroalkyl carboxylate, perfluoroalkyl sulfonate and oxyethylene perfluoroalkyl ether, and biosurfactants such as spiculisporic acids, rhamnolipid and lysolecithin.

These surfactants may be used alone or in combination. The balance between the hydrophilicity/hydrophobicity of the surfactant (HLB) is preferably in the range of 3 to 20 in view of dissolving stability or the like.

The amount of the surfactant to be added is preferably from about 0.001% by weight to about 5% by weight, and more preferably from about 0.01% by weight to about 3% by weight.

Further, other various additives can be added to the ink, such as a permeating agent for adjusting permeating property of the ink; polyethylene imines or polyamines, polyvinyl pyrrolidone, polyethylene glycol, ethyl cellulose and a carboxy methyl cellulose, in order to control the ink ejection property, and compounds of an alkali metal such as potassium hydroxide, sodium hydroxide and lithium hydroxide for adjusting conductivity and pH of the ink. As needed, a pH buffer, an antioxidant, a mildew preventing agent, a viscosity adjusting agent, a conductive agent, an ultraviolet ray absorbing agent, a chelating agent or the like can also be added.

Preferred characteristics of the ink will be described. First, the surface tension of the ink is preferably from about 20 mN/m to about 45 mN/m. Here, the value as the surface tension is measured under the conditions of 23° C. and 55% RH by the use of a Willhermy type surface tension meter (produced by Kyowa Interface Science Co., Ltd.) is used.

The ink viscosity is, for example, from about 1.5 mPa·s to about 30 mPa·s.

The viscosity here is determined as a value measured by using RHEOMAT 115 (manufactured by Contraves), at a measuring temperature of 23° C. and the shearing speed of 1400 $s^{-1}$.

The ink composition is not particularly limited to the above structure, and may include other functional materials such as a crystal material or an electronic material, other than the recording material.

In the above embodiments, a full-color image is recorded on the recording medium 8 by ejecting the ink droplets 20A of black, yellow, magenta and cyan from the ink jet recording head 20 in a selective manner according to image data. However, such a method is not only related to the recording of characters or images on recording mediums, but is also applicable to the droplet ejection (spraying) apparatuses of all kinds that are industrially used.

Examples

Hereinafter, the invention will be described in further detail with reference to the examples. It should be noted that these examples are not intended to limit the scope of the invention.

Examples 1 to 3, Comparative Examples 1 and 2

An image is formed with a recording device having a similar structure to that of the first embodiment (see FIG. 1 to FIGS. 3A and 3B; note that only a recording head for black is used), with the application of different levels of pressure as shown in Table 1, and evaluations are made.

A metal roll of stainless steel is used as a pressure applying unit, which is negatively charged to have the same negative polarity as the ink receiving particles. The pressure applied to the ink receiving particle layer by a metal roll as a pressure applying unit is adjusted by the type of spring members that support the ends of the metal roll.

In the examples, the thickness of the releasing layer formed by a releasing agent on the intermediate transfer unit (the amount of the releasing agent) is 1 μm; the thickness of the ink receiving particle layer on the intermediate transfer unit is 15 μm; the ejection amount of the ink at the image area density of 1200×1200 dpi (dpi; the number of dots per 1 inch square) is 4 pL per pixel; and the recording medium is OK topcoat N paper (manufactured by Oji paper Co., Ltd.). The ink receiving particles and ink are prepared in the following manner.

| (Ink receiving particles A) | |
|---|---|
| Sytrene/n-butylmethacrylate/methacrylic acid copolymer particles (matrix particles: ratio of the polar monomer; 33%, average particle diameter; 8 μm) | 100 parts by weight |
| Amorphous silica (particles that constitute the matrix particles; AEROSIL OX50, manufactured by Degussa GmbH; average particle diameter; 0.04 μm) | 1 part by weight |
| Amorphous silica (particles that constitute the matrix particles; AEROSIL TT600, manufactured by Degussa GmbH; average particle diameter; 0.04 μm) | 1 part by weight |
| Polypropylene wax (PELESTAT300, manufactured by Sanyo Chemical Industries, Ltd.) | 1 part by weight |

The above components are mixed and stirred using a mill with the addition of a small amount of polyvinyl alcohol, thereby preparing the ink receiving particles A.

| (Ink) | |
|---|---|
| Carbon black (CB) | 5 parts by weight |
| Styrene/n-butylmethacrylate/methacrylic acid | 1.5 parts by weight |
| Glycerin | 20 parts by weight |
| Triethylene glycol | 5 parts by weight |
| Diethylene glycol monobutyl ether | 2 parts by weight |
| OLFINE E 1010 (manufactured by Nissin Chemical Industry Co., Ltd.) | 1 part by weight |
| Water | balance |

The above components are mixed to obtain a liquid. The surface tension of the obtained liquid is 31 mN/m.

(Evaluation)

—Drying Time—

A 100% coverage pattern is formed on a recording medium (OK KINFUJI, manufactured by Oji paper Co., Ltd.), and after a lapse of a predetermined time period, another sheet of OK KINFUJI is pressed onto the printed pattern under a load of $1.9\times10^4$ N/m$^2$. Then, the time after the lapse of which the liquid is not transferred onto the sheet of OK KINFUJI on the pressing side is determined as the drying time. The evaluations are made according to the following criteria:

A: The drying time is less than 0.5 second.

B: The drying time is 0.5 second or more and less than 1 second.

C: The drying time is 1 second or more and less than 3 seconds.

D: The drying time is 3 seconds or more.

—Blurring (Ink Spreading)—

A 1 dot line pattern is printed and the blurring thereof is evaluated according to a sensory evaluation method, by reference to the boundary sample with a predetermined degree of blurring. The evaluations are made according to the following criteria:

A: No blurring is observed even in a magnified image.

B: Blurring can be observed when the image is magnified, but is not recognized by the naked eye, and thus within the allowable range.

C: Blurring is observed by the naked eye but is within the allowable range.

D: Distinct blurring is observed by the naked eye and is beyond the allowable range.

—Unevenness in Density and Glossiness—

A solid pattern is printed and the unevenness in density and glossiness thereof is evaluated to a sensory evaluation method, by reference to the boundary sample with a predetermined degree of unevenness in density and glossiness:

A: No unevenness in density or glossiness is observed even in a magnified image.

B: Unevenness in density or glossiness can be observed when the image is magnified, but is not recognized by the naked eye, and thus within the allowable range.

C: Unevenness in density or glossiness is observed by the naked eye but is within the allowable range.

D: Distinct unevenness in density or glossiness is observed by the naked eye and is beyond the allowable range.

TABLE 1

| | Comparative Example 1 | Example 1 | Example 2 | Example 3 | Comparative Example 2 |
|---|---|---|---|---|---|
| Pressure applied by pressure applying unit | $5\times10^2$ Pa | $5\times10^3$ Pa | $5\times10^5$ Pa | $2\times10^6$ Pa | $2\times10^7$ Pa |
| Drying time | D | B | A | B | D |
| Blurring | D | B | A | A | D |
| Unevenness in density and glossiness | D | C | A | B | D |

From the above results, it can be understood that Examples 1 to 3 are superior to Comparative Examples 1 and 2, in terms of the drying time, blurring, uneveness in density and glossiness.

Examples 4 to 6, Comparative Examples 3 and 4

Images are formed in the same manner as that in Example 1, except that a recording device having a similar structure to that of the second embodiment is used (see FIGS. 4 and 5; note that only a recording head for black is used) with the application of different levels of vibrations by a vibration applying unit, and evaluations are made according to the same criteria as that used in the above examples.

The vibration applying unit used here is a device containing an ultrasonic vibrator capable of outputting in the range of from 1 kHz to 200 kHz in a cabinet, and the device is negatively charged to have the same negative polarity as that of the ink receiving particles.

TABLE 2

| | Comparative Example 3 | Example 4 | Example 5 | Example 6 | Comparative Example 4 |
|---|---|---|---|---|---|
| Vibration frequency applied by vibration applying unit | 1 kHz | 8 kHz | 30 kHz | 60 kHz | 150 kHz |
| Drying time | D | B | A | A | D |
| Blurring | D | B | A | A | D |
| Unevenness in density and glossiness | D | A | A | C | D |

From the above results, it can be understood that Examples 4 to 6 are superior to Comparative Examples 3 and 4, in terms of the drying time, blurring, uneveness in density and glossiness.

Examples 7 and 8, Comparative Example 5

Images are formed in the same manner as that in Example 1 using a recording device having a similar structure to that of the first embodiment (see FIG. 1 to FIGS. 3A and 3B; note that only a recording head for black is used), except that different types of the ink receiving particles are used, and evaluations are made according to the same criteria as that used in the above examples. The pressure applied to the ink receiving particle layer by the pressure applying unit is set to be $5\times10^5$ Pa.

| (Ink receiving particles B) | |
|---|---|
| Sytrene/n-butylmethacrylate/methacrylic acid copolymer particles (matrix particles: ratio of the polar monomer; 8.5%, average particle diameter; 7 μm) | 100 parts by weight |
| Amorphous silica (particles that constitute the matrix particles; AEROSIL OX50, manufactured by Degussa GmbH; average particle diameter; 0.04 μm) | 1 part by weight |
| Amorphous silica (particles that constitute the matrix particles; AEROSIL TT600, manufactured by Degussa GmbH; average particle diameter; 0.04 μm) | 1 part by weight |
| Polypropylene wax (PELESTAT300, manufactured by Sanyo Chemical Industries, Ltd.) | 1 part by weight |

The above components are mixed and stirred using a mill with the addition of a small amount of polyvinyl alcohol, thereby preparing the ink receiving particles B.

| (Ink receiving particles C) | |
|---|---|
| Sytrene/n-butylmethacrylate/methacrylic acid copolymer particles (matrix particles: ratio of the polar monomer; 92%, average particle diameter; 9 μm) | 100 parts by weight |
| Amorphous silica (particles that constitute the matrix particles; AEROSIL OX50, manufactured by Degussa GmbH; average particle diameter; 0.04 μm) | 1 part by weight |
| Amorphous silica (particles that constitute the matrix particles; AEROSIL TT600, manufactured by Degussa GmbH; average particle diameter; 0.04 μm) | 1 part by weight |
| Polypropylene wax (PELESTAT300, manufactured by Sanyo Chemical Industries, Ltd.) | 1 part by weight |

The above components are mixed and stirred using a mill with the addition of a small amount of polyvinyl alcohol, thereby preparing the ink receiving particles C.

TABLE 3

| | Comparative Example 5 | Example 7 | Example 8 |
|---|---|---|---|
| Type of ink receiving particles (ratio of polar monomer in organic particles) | B (8.5 mol %) | A (33 mol %) | C (92 mol %) |
| Drying time | D | A | B |
| Blurring | C | A | B |
| Unevenness in density and glossiness | D | A | D |

From the above results, it can be understood that Examples 7 and 8 are superior to Comparative Example 5, in terms of the drying time, blurring, unevenness in density and glossiness.

What is claimed is:

1. A recording device comprising:

an intermediate transfer unit;

a supply unit that supplies ink receiving particles that receive an ink onto the intermediate transfer unit in the form of a layer;

a particle density increasing unit that increases the particle density of the layer of the ink receiving particles supplied onto the intermediate transfer unit;

an ink application unit that applies an ink to the layer of the ink receiving particles supplied onto the intermediate transfer unit;

a transfer unit that transfers the layer of the ink receiving particles onto a recording medium; and a fixing unit that fixes the layer of the ink receiving particles transferred onto the recording medium.

2. The recording device according to claim 1, wherein the particle density increasing unit applies pressure to the layer of the ink receiving particles supplied onto the intermediate transfer unit.

3. The recording device according to claim 2, wherein the pressure is applied in the range of from about $10^3$ Pa to about $10^7$ Pa.

4. The recording device according to claim 1, wherein the particle density increasing unit applies vibration to the layer of the ink receiving particles supplied onto the intermediate transfer unit.

5. The recording device according to claim 4, wherein the vibration is applied in the range of from about 2 kHz to about 100 kHz in frequency.

6. The recording device according to claim 1, wherein the particle density increasing unit applies pressure and vibration to the layer of the ink receiving particles supplied onto the intermediate transfer unit.

7. The recording device according to claim 6, wherein the pressure is applied in the range of from about $10^3$ Pa to about $10^7$ Pa and the vibration is applied in the range of from about 2 kHz to about 100 kHz in frequency.

8. The recording device according to claim 1, wherein the ink receiving particles have a polarity and the particle density increasing unit is charged to have the same polarity as the ink receiving particles.

9. The recording device according to claim 1, wherein the ink receiving particles at least contain a resin comprising from about 10 mol % to about 90 mol % of a polar monomer having a polar group with respect to the total amount of the monomer.

10. The recording device according to claim 1, wherein the ink receiving particles are composite particles of aggregated plural particles.

11. A recording device comprising:

a supply unit that supplies ink receiving particles that receive an ink onto a recording medium in the form of a layer;

a particle density increasing unit that increases the particle density in the layer of the ink receiving particles supplied onto the recording medium;

an ink application unit that applies an ink to the layer of the ink receiving particles supplied onto the recording medium; and a fixing unit that fixes the layer of the ink receiving particles having the ink applied thereto.

12. The recording device according to claim 11, wherein the particle density increasing unit applies pressure to the layer of the ink receiving particles supplied onto the recording medium.

13. The recording device according to claim 12, wherein the pressure is applied in the range of from about $10^3$ Pa to about $10^7$ Pa.

14. The recording device according to claim 11, wherein the particle density increasing unit applies vibration to the layer of the ink receiving particles supplied onto the recording medium.

15. The recording device according to claim 14, wherein the vibration is applied in the range of from about 2 kHz to about 100 kHz in frequency.

16. The recording device according to claim 11, wherein the particle density increasing unit applies pressure and vibration to the layer of the ink receiving particles supplied onto the recording medium.

17. The recording device according to claim 16, wherein the pressure is applied in the range of from about $10^3$ Pa to about $10^7$ Pa and the vibration is applied in the range of from about 2 kHz to about 100 kHz in frequency.

18. The recording device according to claim 11, wherein the ink receiving particles have a polarity and the particle density increasing unit is charged to have the same polarity as the ink receiving particles.

19. The recording device according to claim 11, wherein the ink receiving particles at least contain a resin comprising about from 10 mol % to about 90 mol % of a polar monomer having a polar group with respect to the total amount of the monomer.

20. The recording device according to claim 11, wherein the ink receiving particles are composite particles of aggregated plural particles.

* * * * *